US012291885B2

(12) United States Patent
Chevis

(10) Patent No.: US 12,291,885 B2
(45) Date of Patent: May 6, 2025

(54) FITTING RING

(71) Applicant: Apache Industrial Services, Inc., Houston, TX (US)

(72) Inventor: Kenneth M. Chevis, Metairie, LA (US)

(73) Assignee: Apache Industrial Services, Inc., Houston, TX (US)

( * ) Notice: Subject to any disclaimer, the term of this patent is extended or adjusted under 35 U.S.C. 154(b) by 0 days.

(21) Appl. No.: 17/723,158

(22) Filed: Apr. 18, 2022

(65) Prior Publication Data

US 2022/0243486 A1 Aug. 4, 2022

Related U.S. Application Data

(60) Division of application No. 16/222,825, filed on Dec. 17, 2018, now Pat. No. 11,306,492, which is a (Continued)

(51) Int. Cl.
*E04G 7/28* (2006.01)
*E04B 1/16* (2006.01)
(Continued)

(52) U.S. Cl.
CPC ..... *E04G 7/28* (2013.01); *E04B 1/16* (2013.01); *E04B 1/2403* (2013.01); *E04G 5/02* (2013.01); *E04G 7/12* (2013.01); *E04G 9/06* (2013.01); *E04G 11/02* (2013.01); *E04G 11/28* (2013.01); *E04G 11/365* (2013.01); *E04G 11/50* (2013.01); *E04G 17/002* (2013.01); *E04G 17/04* (2013.01); *E04G 17/0651* (2013.01); *E04G 17/14* (2013.01); *E04G 25/065* (2013.01); *E21D 11/10* (2013.01); *E04C 2003/0452* (2013.01); *E04C 2003/0465* (2013.01); *E04C 2003/0491* (2013.01); *E04G 2001/242* (2013.01); *E04G 5/165* (2013.01); *E04G 7/307* (2013.01); *E04G 2009/028* (2013.01); *E04G 2011/505* (2013.01);
(Continued)

(58) Field of Classification Search
CPC .... E04G 7/28; E04G 5/02; E04G 7/12; E04G 17/04; E04B 1/16; E04B 1/2403
See application file for complete search history.

(56) References Cited

U.S. PATENT DOCUMENTS 559,931 A 5/1896 Campbell
1,163,188 A 12/1915 Waite
(Continued)

FOREIGN PATENT DOCUMENTS

BE 1006369 A6 8/1994
CA 2712330 A1 7/2011
(Continued)

OTHER PUBLICATIONS

PCT International Search Report and Written Opinion; PCT/US2021/020113; Aug. 2021.
(Continued)

*Primary Examiner* — Beth A Stephan
(74) *Attorney, Agent, or Firm* — Lerner David LLP

(57) ABSTRACT

Various implementations described herein are directed to a load bearing ledger fitting, a modular header beam, a perimeter safety deck, a multi-purpose bearing plate, and a mega-shore bearing plate of an integrated construction system.

15 Claims, 31 Drawing Sheets

Related U.S. Application Data continuation-in-part of application No. 15/971,620, filed on May 4, 2018, now Pat. No. 11,976,483, which is a continuation-in-part of application No. 15/910,698, filed on Mar. 2, 2018, now Pat. No. 10,415,262, which is a continuation-in-part of application No. 15/845,962, filed on Dec. 18, 2017, now Pat. No. 10,465,399, which is a continuation-in-part of application No. 15/630,923, filed on Jun. 22, 2017, now Pat. No. 10,472,823.

(60) Provisional application No. 62/471,173, filed on Mar. 14, 2017, provisional application No. 62/354,325, filed on Jun. 24, 2016.

(51) Int. Cl.

| | |
|---|---|
| ***E04B 1/24*** | (2006.01) |
| ***E04G 5/02*** | (2006.01) |
| ***E04G 7/12*** | (2006.01) |
| ***E04G 9/06*** | (2006.01) |
| ***E04G 11/02*** | (2006.01) |
| ***E04G 11/28*** | (2006.01) |
| ***E04G 11/36*** | (2006.01) |
| ***E04G 11/50*** | (2006.01) |
| ***E04G 17/00*** | (2006.01) |
| ***E04G 17/04*** | (2006.01) |
| ***E04G 17/065*** | (2006.01) |
| ***E04G 17/14*** | (2006.01) |
| ***E04G 25/06*** | (2006.01) |
| ***E21D 11/10*** | (2006.01) |
| *E04C 3/04* | (2006.01) |
| *E04G 1/24* | (2006.01) |
| *E04G 5/16* | (2006.01) |
| *E04G 7/30* | (2006.01) |
| *E04G 9/02* | (2006.01) |
| *E04G 25/00* | (2006.01) |

(52) U.S. Cl.
CPC .. *E04G 2025/003* (2013.01); *E04G 2025/006* (2013.01)

(56) References Cited

U.S. PATENT DOCUMENTS 1,176,005 A 3/1916 Waite
1,473,504 A 11/1923 Earl
1,575,268 A 3/1926 Howard
1,653,126 A 12/1927 Schwerin
RE17,629 E 3/1930 Wehr
1,768,543 A 7/1930 Clausing
1,890,336 A 12/1932 Nodine
1,890,386 A 12/1932 Kingston
1,919,405 A 7/1933 Wilson
1,970,547 A 8/1934 Anderon
1,974,628 A 9/1934 Presley
1,974,752 A 9/1934 Roberg
2,261,907 A 11/1941 Uecker et al.
2,357,819 A 9/1944 Greer
2,382,201 A 8/1945 Burke et al.
2,479,962 A 8/1949 Paulson
2,573,806 A 10/1951 Yoshimoto
2,631,346 A 3/1953 Wengen et al.
2,760,249 A 8/1956 Woodrow
2,804,673 A 9/1957 Fex
2,877,974 A 3/1959 Estes
2,944,120 A 7/1960 Ruben
2,970,677 A 2/1961 Springs, Jr. et al.
2,974,762 A 3/1961 Mauritz
2,976,597 A 3/1961 Bert
3,005,282 A 10/1961 Christiansen
3,018,898 A 1/1962 Frazelle
3,054,486 A 9/1962 La Rambelje
3,077,653 A 2/1963 Ward
3,124,330 A 3/1964 Robinson
3,168,772 A 2/1965 Williams
3,204,918 A 9/1965 Bonin
3,217,833 A 11/1965 Smith
3,222,829 A 12/1965 Bening
3,247,639 A 4/1966 Dela
3,288,427 A 11/1966 Pluckebaum
3,318,057 A 5/1967 Norsworthy
3,325,957 A 6/1967 Demeules
3,392,801 A 7/1968 Gethmann
3,420,012 A 1/1969 Liskey, Jr. et al.
3,462,110 A 8/1969 Cheslock
3,465,995 A 9/1969 Whitman
3,486,287 A 12/1969 Guillon
3,491,852 A 1/1970 Leist
3,493,208 A 2/1970 Sato
3,533,587 A 10/1970 Smith
3,533,857 A 10/1970 Vecchiarelli
3,550,723 A 12/1970 Gentry et al.
3,559,357 A 2/1971 Lowe
3,578,060 A 5/1971 Spencer
3,601,356 A 8/1971 Yurick
3,684,058 A 8/1972 Brown
3,696,578 A 10/1972 Swensen et al.
3,735,953 A 5/1973 Dashew
3,751,790 A 8/1973 Fraizer
3,776,498 A * 12/1973 Peters ..... E04G 5/06 248/242
3,790,117 A 2/1974 Winkler
3,815,858 A 6/1974 Mocny et al.
3,822,850 A 7/1974 Elias
3,862,737 A 1/1975 Fuston, Jr.
3,876,046 A 4/1975 Lerner
3,885,648 A * 5/1975 Beziat ..... E04G 7/301 403/349
3,890,750 A 6/1975 Berman
3,900,179 A 8/1975 Mocny et al.
3,900,182 A 8/1975 Berman
3,993,282 A 11/1976 Berman
4,003,543 A 1/1977 Doubleday
4,030,266 A 6/1977 Cody
4,030,694 A 6/1977 Schimmel
4,032,100 A 6/1977 Kahn
4,033,081 A 7/1977 Perkins, Jr.
4,036,466 A 7/1977 Van Meter
4,102,096 A 7/1978 Cody
4,106,256 A 8/1978 Cody
4,121,804 A 10/1978 O'Leary
4,123,031 A 10/1978 Hyre
4,133,433 A 1/1979 Wolf
4,158,452 A 6/1979 Gates
4,162,682 A 7/1979 Miller et al.
4,163,537 A 8/1979 Mourgue
4,188,017 A 2/1980 Dingler
4,194,338 A 3/1980 Trafton
4,202,145 A 5/1980 Coulter et al.
4,248,024 A 2/1981 Dahlstrom
4,261,144 A 4/1981 Rizzo
4,342,440 A 8/1982 Eyden
4,348,002 A 9/1982 Eyden
4,349,491 A 9/1982 Eyden
4,371,203 A 2/1983 Munro
4,372,425 A 2/1983 Murphy
4,458,461 A 7/1984 Holley
4,470,574 A 9/1984 Jackson
4,473,209 A 9/1984 Gallis et al.
4,481,748 A 11/1984 D'Alessio
4,493,172 A 1/1985 Jones
4,499,967 A 2/1985 Anderson
4,516,372 A 5/1985 Grutsch
4,529,163 A 7/1985 Dingler
4,558,544 A 12/1985 Albrecht et al.
4,582,001 A 4/1986 Leikarts
4,587,786 A 5/1986 Woods
4,619,433 A 10/1986 Maier
4,685,264 A 8/1987 Landis
4,742,985 A 5/1988 Mathis

(56) References Cited

U.S. PATENT DOCUMENTS 4,743,202 A 5/1988 Bach
4,761,847 A 8/1988 Savage et al.
4,776,557 A 10/1988 Turner
4,787,183 A 11/1988 Johnston
4,805,365 A 2/1989 Bastian
4,805,735 A 2/1989 Anderson
4,813,196 A 3/1989 Bokelund et al.
4,821,844 A 4/1989 Huffman et al.
4,826,113 A 5/1989 Winters
4,831,791 A 5/1989 Ball
4,880,195 A 11/1989 Lepley
4,881,716 A 11/1989 Dingler
4,919,268 A 4/1990 Young et al.
5,009,050 A 4/1991 Gruber
5,029,670 A 7/1991 Whitmer
5,029,803 A 7/1991 Schworer
5,044,601 A 9/1991 Miller
5,048,781 A 9/1991 Breen
5,078,360 A 1/1992 Spera
5,104,079 A 4/1992 Hardtke
5,125,617 A 6/1992 Miller
5,127,342 A * 7/1992 Taylor ..... A47B 57/265 211/187
5,146,816 A 9/1992 Badstieber
5,150,557 A 9/1992 Gregory
5,154,837 A 10/1992 Jones
5,174,909 A 12/1992 Ward
5,192,145 A 3/1993 Rixen et al.
5,219,473 A 6/1993 Sandwith
5,228,258 A 7/1993 Onoda et al.
5,240,089 A 8/1993 Spera
5,263,296 A * 11/1993 Spera ..... E04G 11/48 52/646
5,265,836 A 11/1993 Dale
5,292,098 A 3/1994 Worthington
5,307,601 A 5/1994 Mccracken
5,367,852 A 11/1994 Masuda
5,379,566 A 1/1995 Schwörer
5,385,323 A 1/1995 Garelick
5,447,249 A 9/1995 Vickers
5,509,635 A 4/1996 Jaruzel
5,529,144 A 6/1996 Henderson
5,549,176 A 8/1996 Hawkins
5,560,730 A * 10/1996 Gillard ..... E04G 7/307 403/294
5,570,500 A 11/1996 Merkel
5,575,938 A 11/1996 Ono
5,641,036 A 6/1997 Maxwell
5,655,336 A 8/1997 Azar
5,680,732 A 10/1997 Skouras
5,685,121 A 11/1997 DeFrancesco et al.
5,711,397 A 1/1998 Flora et al.
5,729,948 A 3/1998 Levy et al.
5,729,950 A 3/1998 Hardy
5,735,100 A 4/1998 Campbell
5,746,535 A 5/1998 Kohler
5,791,096 A 8/1998 Chen
5,863,020 A 1/1999 Olson et al.
5,941,486 A 8/1999 Riblet
5,961,240 A * 10/1999 Bobrovniczky ..... E04G 7/307 182/186.8
5,979,119 A 11/1999 Trafton
5,979,138 A 11/1999 Allen
6,003,631 A * 12/1999 Knauth ..... E04G 3/20 182/150
6,059,258 A 5/2000 Jackson
6,092,623 A 7/2000 Collavino
6,106,186 A 8/2000 Taipale et al.
6,161,359 A 12/2000 Ono
6,173,809 B1 1/2001 Cole et al.
6,186,856 B1 2/2001 Chen
6,298,629 B1 10/2001 Ador
6,318,572 B1 * 11/2001 Lai ..... A47G 25/0664 211/205
6,321,501 B1 11/2001 Ignash
6,363,685 B1 4/2002 Kugler
6,370,741 B1 4/2002 Lu
6,422,345 B1 7/2002 Schwörer
6,439,344 B1 8/2002 Cole
6,450,291 B1 9/2002 Ono
6,520,471 B2 2/2003 Jones et al.
6,520,705 B2 2/2003 Stasney, Jr.
6,554,235 B1 4/2003 Fortier
6,575,652 B2 6/2003 Krauss
6,591,574 B2 7/2003 Humphrey
6,688,430 B1 * 2/2004 Wallther ..... F16B 7/22 182/186.7
6,712,543 B1 3/2004 Schmalzhofer
6,722,468 B2 * 4/2004 Albano ..... E04G 3/20 182/150
6,751,914 B2 6/2004 Zeh et al.
6,752,570 B2 6/2004 Lanka
6,872,117 B1 3/2005 Chen
6,874,741 B2 4/2005 Mirsberger
6,886,662 B2 * 5/2005 Riley ..... E04G 5/048 248/235
6,913,422 B2 7/2005 Rogers
6,953,106 B2 10/2005 Weston et al.
6,962,234 B1 11/2005 Reeves
7,032,268 B2 4/2006 Jackson
7,096,641 B2 8/2006 Birnbaum et al.
7,120,664 B2 10/2006 Sawa et al.
7,165,361 B2 1/2007 Vanagan
7,178,765 B2 2/2007 Huang
7,249,624 B2 7/2007 Zeh et al.
7,275,731 B1 10/2007 Shinault
7,404,532 B1 7/2008 Baril
7,530,540 B2 * 5/2009 Long ..... E04B 2/7845 248/219.3
7,823,347 B1 11/2010 Blinn
7,913,463 B2 3/2011 Russell
7,918,059 B2 4/2011 Repasky
7,950,199 B2 5/2011 Newhouse et al.
8,061,672 B1 11/2011 Kaufman
8,083,192 B2 12/2011 Wells et al.
8,136,633 B2 3/2012 Rogers
8,181,742 B1 * 5/2012 Ranese ..... E04G 5/062 182/136
8,191,840 B2 * 6/2012 Jenestreet ..... F21V 21/116 24/20 R
8,302,356 B2 11/2012 Knight, III et al.
8,403,280 B2 3/2013 Halverson et al.
8,418,425 B1 4/2013 Santini
8,505,864 B1 8/2013 Taylor et al.
8,616,519 B2 * 12/2013 Bacon ..... E04G 25/00 249/18
8,635,820 B2 1/2014 Lafferty, III et al.
8,671,635 B2 3/2014 Jones
8,684,412 B2 4/2014 Steins
8,827,587 B2 9/2014 Didehvar
8,850,753 B2 10/2014 Tabibnia
8,869,477 B2 10/2014 Ha et al.
8,898,999 B1 12/2014 Kugler et al.
8,978,176 B1 3/2015 Oh
8,978,822 B2 * 3/2015 Kreller ..... E04G 1/14 182/178.1
9,015,950 B2 * 4/2015 Husebo ..... B23P 19/00 29/897.3
9,056,639 B2 6/2015 Bank
9,074,379 B2 7/2015 Ciuperca
9,153,860 B2 10/2015 Tserodze et al.
9,179,774 B2 * 11/2015 Kessell ..... A47B 57/26
9,206,632 B1 12/2015 Fields
9,232,783 B2 * 1/2016 Blackwell ..... A01M 31/02
9,249,565 B2 2/2016 Merrifield
9,388,561 B2 7/2016 Johnson et al.
9,422,711 B1 8/2016 Hendry
9,546,489 B2 1/2017 Rosati
9,556,624 B1 1/2017 Law
9,587,298 B2 3/2017 Lin et al.
9,637,937 B2 * 5/2017 Wallther ..... E04G 7/22
9,719,267 B2 8/2017 Rogers

(56) References Cited

U.S. PATENT DOCUMENTS 9,951,528 B2 4/2018 Kugler et al.
10,018,208 B2 7/2018 Hollis et al.
10,106,991 B2 10/2018 Dombrowski et al.
10,125,505 B2 * 11/2018 So ..... E04G 5/007
10,266,993 B2 4/2019 Szekely
10,415,311 B2 * 9/2019 Parker ..... F16B 2/185
10,422,140 B2 9/2019 Mitchell
10,415,262 B2 11/2019 Chevis
10,465,339 B2 11/2019 Chevis
10,465,399 B2 11/2019 Chevis
10,472,823 B2 11/2019 Chevis
10,570,632 B1 2/2020 Hartman
10,640,968 B2 5/2020 Teffenhart, Jr.
10,641,302 B1 5/2020 Huffman et al.
10,797,372 B2 * 10/2020 Hemmervall ..... F16G 13/18
10,844,613 B2 11/2020 Repasky et al.
10,995,504 B1 * 5/2021 Cook ..... E04G 7/22
11,199,011 B2 12/2021 Kreller
11,203,470 B2 12/2021 Ezra et al.
11,530,541 B1 12/2022 Switzer
2002/0003061 A1 * 1/2002 Philippe ..... E04G 3/28 182/224
2002/0036118 A1 * 3/2002 Ono ..... E04G 7/32 182/178.1
2002/0084141 A1 * 7/2002 Thomas ..... E04G 1/15 182/150
2002/0092961 A1 7/2002 Gallis
2002/0185335 A1 12/2002 Verdyk
2003/0194265 A1 10/2003 Krauss
2003/0213152 A1 * 11/2003 Kim ..... G09F 7/18 40/607.14
2004/0035064 A1 2/2004 Kugler et al.
2004/0055249 A1 3/2004 Kennedy
2004/0118065 A1 6/2004 Jackson et al.
2004/0200172 A1 10/2004 Beck et al.
2004/0231922 A1 * 11/2004 Schwoerer ..... E04G 7/26 182/178.1
2004/0237437 A1 12/2004 Hur
2005/0045785 A1 3/2005 Cohen
2005/0166483 A1 8/2005 Mead
2005/0217040 A1 10/2005 Jackson
2006/0011802 A1 1/2006 Di Cesare
2006/0027729 A1 2/2006 McCracken
2006/0042179 A1 3/2006 Vanagan
2006/0175130 A1 8/2006 Riley
2006/0191236 A1 8/2006 Surowiecki
2006/0207215 A1 9/2006 Bruno
2006/0239769 A1 10/2006 Schworer
2006/0272889 A1 12/2006 Paquette
2007/0021048 A1 1/2007 Henning
2007/0045048 A1 3/2007 Wyse
2007/0056799 A1 3/2007 Leidner
2007/0074480 A1 4/2007 Kleila
2008/0017783 A1 1/2008 Vanagan
2008/0105172 A1 5/2008 Repasky
2008/0141601 A1 6/2008 Mead
2008/0178641 A1 7/2008 Himmen
2008/0210725 A1 9/2008 Birtwisle et al.
2008/0244006 A1 10/2008 Weisner et al.
2008/0244996 A1 10/2008 Gillespie et al.
2009/0056258 A1 3/2009 Currier
2009/0188189 A1 8/2009 Repasky
2009/0211195 A1 8/2009 Schwoerer
2009/0212195 A1 8/2009 Arocena Bergareche et al.
2009/0230283 A1 9/2009 Brewka et al.
2009/0301815 A1 12/2009 Rogers
2010/0000822 A1 1/2010 Wall
2010/0005735 A1 1/2010 Gillespie et al.
2010/0024176 A1 2/2010 Ubinana
2010/0025563 A1 2/2010 Seng
2010/0071141 A1 3/2010 Reiner
2010/0122872 A1 5/2010 Korevaar
2010/0218452 A1 9/2010 Wolf
2010/0224447 A1 9/2010 Rogers
2011/0011018 A1 1/2011 Johnson et al.
2011/0101587 A1 5/2011 Quintania et al.
2011/0138723 A1 6/2011 Repasky
2012/0025058 A1 2/2012 Floreani et al.
2012/0076605 A1 3/2012 Crane
2012/0112376 A1 5/2012 Khoo
2012/0117913 A1 5/2012 Melic
2013/0015185 A1 1/2013 Leal et al.
2013/0036688 A1 2/2013 Gosain
2013/0043095 A1 2/2013 Thacker
2013/0161462 A1 6/2013 Haddock
2013/0221175 A1 8/2013 McGee
2013/0228394 A1 9/2013 Sousa et al.
2013/0312357 A1 11/2013 Lin
2013/0333191 A1 * 12/2013 Wallther ..... E04G 7/18 403/345
2014/0020982 A1 1/2014 Hayman et al.
2014/0021424 A1 1/2014 Ramskov
2014/0086669 A1 3/2014 Rogers
2014/0228060 A1 8/2014 Abhyanker
2014/0250821 A1 9/2014 Strickland et al.
2014/0339019 A1 11/2014 Hulett et al.
2014/0361144 A1 12/2014 Mcgahan
2015/0033661 A1 2/2015 Chase
2015/0157885 A1 6/2015 Liu
2015/0211242 A1 7/2015 Rosati
2015/0337548 A1 11/2015 Ciuperca
2016/0002936 A1 1/2016 Cox
2016/0102462 A1 4/2016 Griffiths et al.
2016/0199750 A1 7/2016 Yamagishi
2016/0244984 A1 8/2016 Hollmann
2016/0281376 A1 9/2016 Ward
2016/0305459 A1 10/2016 Park et al.
2017/0037631 A1 2/2017 McManus et al.
2017/0254099 A1 9/2017 Grumberg et al.
2017/0260758 A1 9/2017 Siltala et al.
2017/0292280 A1 10/2017 White
2017/0321413 A1 11/2017 Pridham
2017/0350141 A1 12/2017 Kugler et al.
2017/0370099 A1 12/2017 Chevis
2018/0099233 A1 4/2018 Peiler
2018/0112423 A1 4/2018 Hartman
2018/0119435 A1 5/2018 Jablonski
2018/0187428 A1 7/2018 Maher
2019/0010717 A1 1/2019 Baron
2019/0127996 A1 5/2019 Chevis
2019/0321664 A1 10/2019 Hsu
2020/0011074 A1 1/2020 Chevis
2021/0108427 A1 4/2021 Bacon
2021/0156157 A1 5/2021 Ubinana
2021/0180344 A1 6/2021 McCracken
2021/0246673 A1 8/2021 Haeberle
2022/0010568 A1 * 1/2022 Mikic ..... E04G 7/24

FOREIGN PATENT DOCUMENTS

CH 506685 A 4/1971
CN 1188175 A 7/1998
CN 201835529 U 5/2011
CN 103899083 A 7/2014
CN 203878831 U 10/2014
CN 204386134 U 6/2015
CN 107100358 A 8/2017
CN 207686282 U 8/2018
CN 110700585 A 1/2020
CN 210086830 U 2/2020
DE 9305194 U1 8/1993
DE 9309950 U1 9/1993
DE 4328105 C1 9/1994
DE 19807860 A1 9/1999
DE 20006912 U1 10/1999
DE 29912555 U1 10/1999
DE 10121957 A1 11/2002
DE 102008026989 B3 9/2009
DE 202009010716 U1 11/2009
DE 202010002426 U1 6/2010
EP 2937056 A1 7/1905
EP 0062420 A1 10/1982
EP 0369108 A2 5/1990

(56) References Cited

FOREIGN PATENT DOCUMENTS

| | | | |
|---|---|---|---|
| EP | 0375969 | A1 | 7/1990 |
| EP | 0408209 | A2 | 1/1991 |
| EP | 0729536 | A1 | 9/1996 |
| EP | 678637 | B1 | 7/1998 |
| EP | 1498571 | A1 | 1/2005 |
| EP | 1559851 | A2 | 3/2005 |
| EP | 1544379 | A2 | 6/2005 |
| EP | 2141307 | A2 | 1/2010 |
| EP | 2462296 | A1 | 6/2012 |
| EP | 2982813 | A1 | 2/2016 |
| EP | 3073028 | A1 | 9/2016 |
| ES | 2245264 | B1 | 11/2005 |
| FR | 926917 | A | 10/1947 |
| FR | 1165329 | A | 10/1958 |
| FR | 2527254 | A1 | 11/1983 |
| FR | 2593843 | A1 | 8/1987 |
| GB | 838828 | A | 6/1960 |
| GB | 877463 | A | 9/1961 |
| GB | 1465950 | A | 3/1977 |
| GB | 2133826 | A | 8/1984 |
| GB | 2145761 | A | 4/1985 |
| GB | 2215374 | A | 9/1989 |
| GB | 2398848 | A | 9/2004 |
| GB | 2592433 | A | 9/2021 |
| JP | H 07-279411 | A | 10/1995 |
| JP | H 10-46806 | A | 2/1998 |
| JP | 2002256700 | A | 9/2002 |
| JP | 2004156416 | A | 6/2004 |
| JP | 2009127315 | A | 6/2009 |
| JP | 2016532026 | A | 10/2016 |
| KR | 920008222 | Y1 | 11/1992 |
| KR | 0134600 | Y1 | 2/1999 |
| KR | 20030095163 | A | 12/2003 |
| KR | 200372312 | Y1 | 1/2005 |
| KR | 200381397 | Y1 | 4/2005 |
| KR | 200410996 | Y1 | 3/2006 |
| KR | 20060078341 | A | 7/2006 |
| KR | 10-0682310 | B1 | 2/2007 |
| KR | 20110077096 | A | 7/2011 |
| KR | 101194682 | B1 | 10/2012 |
| KR | 20-0463949 | Y1 | 12/2012 |
| KR | 200469990 | Y1 | 11/2013 |
| KR | 101335478 | B1 | 12/2013 |
| KR | 20150116373 | A | 10/2015 |
| KR | 20170128688 | A | 11/2017 |
| KR | 20190088168 | A | 7/2019 |
| KR | 20190115612 | A | 10/2019 |
| KR | 102166828 | B1 | 10/2020 |
| KR | 102180857 | B1 | 11/2020 |
| KR | 20210043807 | A | 4/2021 |
| WO | 9109191 | A1 | 6/1991 |
| WO | 1998007935 | A1 | 2/1998 |
| WO | 2002003116 | A1 | 8/2002 |
| WO | 2006135223 | A1 | 12/2006 |
| WO | 2007043897 | A2 | 4/2007 |
| WO | 2010054836 | A2 | 5/2010 |
| WO | 2012096639 | A1 | 7/2012 |
| WO | 2017223504 | A1 | 12/2017 |
| WO | 2018143534 | A1 | 8/2018 |

OTHER PUBLICATIONS

PCT International Search Report and Written Opinion; PCT/US2018/066256; Apr. 11, 2019.

PCT International Search Report and Written Opinion; PCT/US2017/039097; 2017.

* cited by examiner

FITTING RING

CROSS-REFERENCE TO RELATED APPLICATIONS

This application is a divisional application of U.S. patent application Ser. No. 16/222,825, filed Dec. 17, 2018, which is a continuation-in-part of U.S. patent application Ser. No. 15/971,620, filed May 4, 2018, which is a continuation-in-part of U.S. patent application Ser. No. 15/910,698, filed Mar. 2, 2018, which is a continuation-in-part of U.S. patent application Ser. No. 15/845,962, filed Dec. 18, 2017, which is a continuation-in-part of U.S. patent application Ser. No. 15/630,923, filed Jun. 22, 2017, which claims the benefit of U.S. Provisional Application No. 62/471,173, filed Mar. 14, 2017, and U.S. Provisional Application No. 62/354,325, filed Jun. 24, 2016, all of which are incorporated herein by reference.

BACKGROUND

This section is intended to provide background information to facilitate a better understanding of various technologies described herein. As the section's title implies, this is a discussion of related art. That such art is related in no way implies that it is prior art. The related art may or may not be prior art. It should therefore be understood that the statements in this section are to be read in this light, and not as admissions of prior art.

There are two types of concrete construction that require some form of formwork: vertical formwork and shoring. Vertical formwork provides the ability to form structures that hold vertical loads. Shoring provides the ability to form structures that hold horizontal loads. Vertical structures like walls, columns and foundations require formwork, and horizontal structures like slabs, beams and girders require shoring to cast them into place as an elevated structural component. Examples where shoring provides horizontal concrete members include: slabs, horizontal concrete girders, cross-t's under highways, etc.

Many companies in existence today have developed specific independent formwork systems and independent shoring systems. They generally carry a sizable inventory of several different types that are both rented and sold to contractors who build concrete structures.

The applications of formwork and shoring are unlimited given the wide range of project types in both the industrial and commercial construction markets. From high-rise buildings, to the construction of an industrial facility, formwork and shoring are used to help contractors cast foundations, columns, walls, elevated slabs and elevated beams in an enormous variety of shapes and uses. Chances are that all of the buildings in which people live and work have some sort of poured in-place concrete that was casted using a formwork system.

Older generation systems required formwork and shoring providers to have significantly large inventories of parts in order to make up the variety of configurations necessary. Those systems consisted of endless amounts of components used by a building contractor. Along with the large amount of inventory items, the assembly efficiency for those systems was often on the low side, as compared to systems in use today. Due to the large amount of pieces, it was common for many of these items to be lost during the construction process.

SUMMARY

Described herein are various implementations of a fitting ring of an integrated construction system. In one implementation, the fitting ring includes an inner portion configured to be coupled to a post. The fitting ring also includes an outer portion configured to be coupled to a ledger rail and configured to allow the post to handle a load from the ledger rail.

Described herein are various implementations of a modular header beam of an integrated construction system. In one implementation, the modular header beam includes a first end and a second end. The modular header beam is an extrusion configured to interchangeably support: shoring panels of a shoring assembly and decking panels of a decking assembly.

Described herein are various implementations of a perimeter safety deck assembly of an integrated construction system. The perimeter safety deck assembly includes a post. A first ledger is coupled to the post in a horizontal configuration. At least one second ledger is coupled to the first ledger and forms a vertical outer wall.

The perimeter safety deck assembly may include a bracing element coupled to the post and the first ledger. The bracing element can be coupled to the post via a ledger clamp and the first ledger via a clip.

The vertical outer wall may include a plurality of second ledgers coupled together to form the vertical outer wall.

The first ledger may be coupled to the post via a ledger clamp.

The perimeter safety deck assembly may include a third ledger coupled to the post and the at least one second ledger. The first ledger and the third ledger may be part of a ledger assembly.

In one implementation, the ledger assembly may include at least one strut coupled to the first ledger and the third ledger.

In one implementation, the ledger assembly may include a plurality of struts coupled to the first ledger and the third ledger. The ledger assembly may include brace members coupled between adjacent struts of the plurality of struts.

In one implementation, the perimeter safety deck assembly may include a bracing element coupled to the post and the third ledger.

The bracing element may be coupled to the post via a ledger clamp.

The bracing element may be coupled to the third ledger via a clip.

In one implementation, a platform may be coupled to the first ledger via a plurality of joists. The platform may be configured to provide worker access, or provide support for shoring or both. The platform may support a modular header beam, the modular header beam may be coupled to the post and a second platform, and the second platform may be configured to provide shoring for a concrete slab.

Described herein are various implementations of a bearing plate of an integrated construction system. The bearing plate includes a surface. The surface has an outer boundary defining an outer edge of the bearing plate. The surface has an inner boundary within the bearing plate that defines an area shaped to interchangeably accommodate a plurality of components of the integrated construction system.

Described herein are various implementations of a bearing plate of an integrated construction system. The bearing plate includes a surface. The surface has an outer boundary defining an outer edge of the bearing plate. The surface has a plurality of inner boundaries within the bearing plate, each of the inner boundaries defining an area shaped to interchangeably accommodate a plurality of components of the integrated construction system.

Also described herein are various implementations of an integrated construction system. In one implementation, the integrated construction system includes a first panel for a formwork configuration of the integrated construction system, a second panel for a shoring configuration of the integrated construction system, and a third panel for a worker access configuration of the integrated construction system. The first panel, the second panel and the third panel are the same panel type.

In one implementation, the panel type may be a form panel. The form panel may be an aluminum form panel. In one implementation, the second panel may supported by a header beam in the shoring configuration. The header beam may be coupled to a plurality of posts. The header beam may be an aluminum header beam and the plurality of posts may be a plurality of aluminum posts. At least one bracing assembly may be coupled between the plurality of posts. The at least one bracing assembly may include a first modular ledger, a second modular ledger, and at least one ledger strut. The bracing assembly may include two ledger struts and ledger brace members.

In one implementation, the panel type may be a modular ledger. In the shoring configuration, the second panel may be part of a bracing assembly. The bracing assembly may include: the second panel, a fourth panel comprising the same panel type, and at least one ledger strut. The bracing assembly may include two ledger struts and ledger brace members.

In the worker access configuration, the third panel and a fifth panel may be part of a second bracing assembly, the fifth panel being the same panel type. A sixth panel may be coupled to the second bracing assembly to form an outer wall of the worker access configuration, the sixth panel being the same panel type. A plurality of modular ledger panels may be coupled together and are coupled to the second bracing assembly to form an outer wall of the worker access configuration. The plurality of modular ledger panels may be coupled together using a ledger splice.

A plurality of joists may be coupled to a top surface of the second bracing assembly. The plurality of joists can support a platform that provides worker access.

Also described herein are various implementations of a method for providing an integrated construction system. A first panel for a formwork configuration of the integrated construction system is provided. A second panel for a shoring configuration of the integrated construction system is provided. A third panel for a worker access configuration of the integrated construction system is provided. The first panel, the second panel and the third panel are a same panel type.

Also described herein are various implementations of a modular ledger of an integrated construction system. In one implementation, the modular ledger includes a rail, having a first end and a second end. Each end of the rail is configured to be coupled to one or more posts and/or assemblies through a coupling component. The rail has a plurality of holes configured to couple to bracing components of the integrated construction system.

The rail may be hollow and constructed of aluminum.

The coupling component may be a ledger clamp, a ledger splice, a ledger guardrail fitting, or a ledger end fitting.

The plurality of holes can be a hole pattern formed longitudinally along each side of the rail.

In one implementation, the rail may be configured to form a wall of a safety deck.

In one implementation, the rail may be configured to form part of a rollback mechanism.

The rail can be configured to form part of a bracing assembly when coupled to the bracing components.

The rail can be configured as a load bearing member when coupled to posts of the integrated construction system.

Also described herein are various implementations of a bracing assembly of an integrated construction system. In one implementation, the bracing assembly includes a first rail configured to be coupled to one or more posts and/or assemblies through a first coupling component, a second rail configured to be coupled to the one or more posts and/or assemblies through a second coupling component, and a first ledger strut coupled to the first rail and the second rail.

In one implementation, the bracing assembly includes a second ledger strut coupled to the first rail and the second rail. In one implementation, the bracing assembly includes ledger brace members coupled between the first ledger strut and the second ledger strut. The first ledger strut, the second ledger strut, and the ledger brace members may be adjusted along the first rail and the second rail. A distance between the first rail and the second rail may be adjusted by adjusting a lateral position of at least one of the first ledger strut and the second ledger strut along the first rail and the second rail.

In one implementation, the first rail and the second rail may have a first hole pattern. The first ledger strut may have a second hole pattern. The first hole pattern and the second hole pattern may be used to couple the first rail to the second rail via the first ledger strut.

Also described herein are various implementations of an integrated construction system component. In one implementation, the integrated construction system component includes a ledger rail configured to be coupled to one or more posts and/or assemblies through a coupling component. The ledger rail is constructed of aluminum and configured to provide bracing for the integrated construction system and handle vertical loads while attached to other components of the integrated construction system.

Also described herein are various implementations of a modular post of an integrated construction system. In one implementation, the modular post includes a longitudinal extruded post having a first end and a second end. Each end of the longitudinal extruded post is configured to receive a post end component. The longitudinal extruded post includes a plurality of grooves cut into the longitudinal extruded post at predetermined locations along the post.

The longitudinal extruded post may be constructed of aluminum.

The modular post may include at least one post fitting mechanically fastened to the longitudinal extruded post. The at least one post fitting can be coupled to the post by sliding the at least one post fitting down the longitudinal extruded post and twisting the at least one post fitting into place. The at least one post fitting can be twisted into place at one of the plurality of grooves. The at least one post fitting may be fastened to the longitudinal extruded post using a screw.

The longitudinal extruded post may include a plurality of ribs along the longitudinal extruded post. The plurality of grooves can be cut into the plurality of ribs.

The post end component may include a post end fitting. The post end fitting may be a permanent fitting.

The post end component may include screw leg components. The screw leg components can be used to vary a height of a shoring assembly of the integrated construction system. The height of the shoring assembly can be varied within an adjustment range.

The longitudinal extruded post can be coupled to a screw leg assembly. In one implementation, the screw leg assembly may remain attached to the longitudinal extruded post using screw leg clips of the screw leg assembly. In one implementation, the longitudinal post and the screw leg assembly can be configured to be moved from a first location to a second location without being disassembled.

The modular post can be configured to be coupled to a coupling component of the integrated construction system. In one implementation, the coupling component can be coupled to a bracing component. In one implementation, the coupling component can be coupled to a modular ledger panel. In one implementation, the coupling component can be coupled to a bracing element.

The above referenced summary section is provided to introduce a selection of concepts in a simplified form that are further described below in the detailed description section. Additional concepts and various other implementations are also described in the detailed description. The summary is not intended to identify key features or essential features of the claimed subject matter, nor is it intended to be used to limit the scope of the claimed subject matter, nor is it intended to limit the number of inventions described herein. Furthermore, the claimed subject matter is not limited to implementations that solve any or all disadvantages noted in any part of this disclosure.

BRIEF DESCRIPTION OF THE DRAWINGS

Implementations of various techniques will hereafter be described with reference to the accompanying drawings. It should be understood, however, that the accompanying drawings illustrate only the various implementations described herein and are not meant to limit the scope of various techniques described herein.

DETAILED DESCRIPTION

Figure 1:
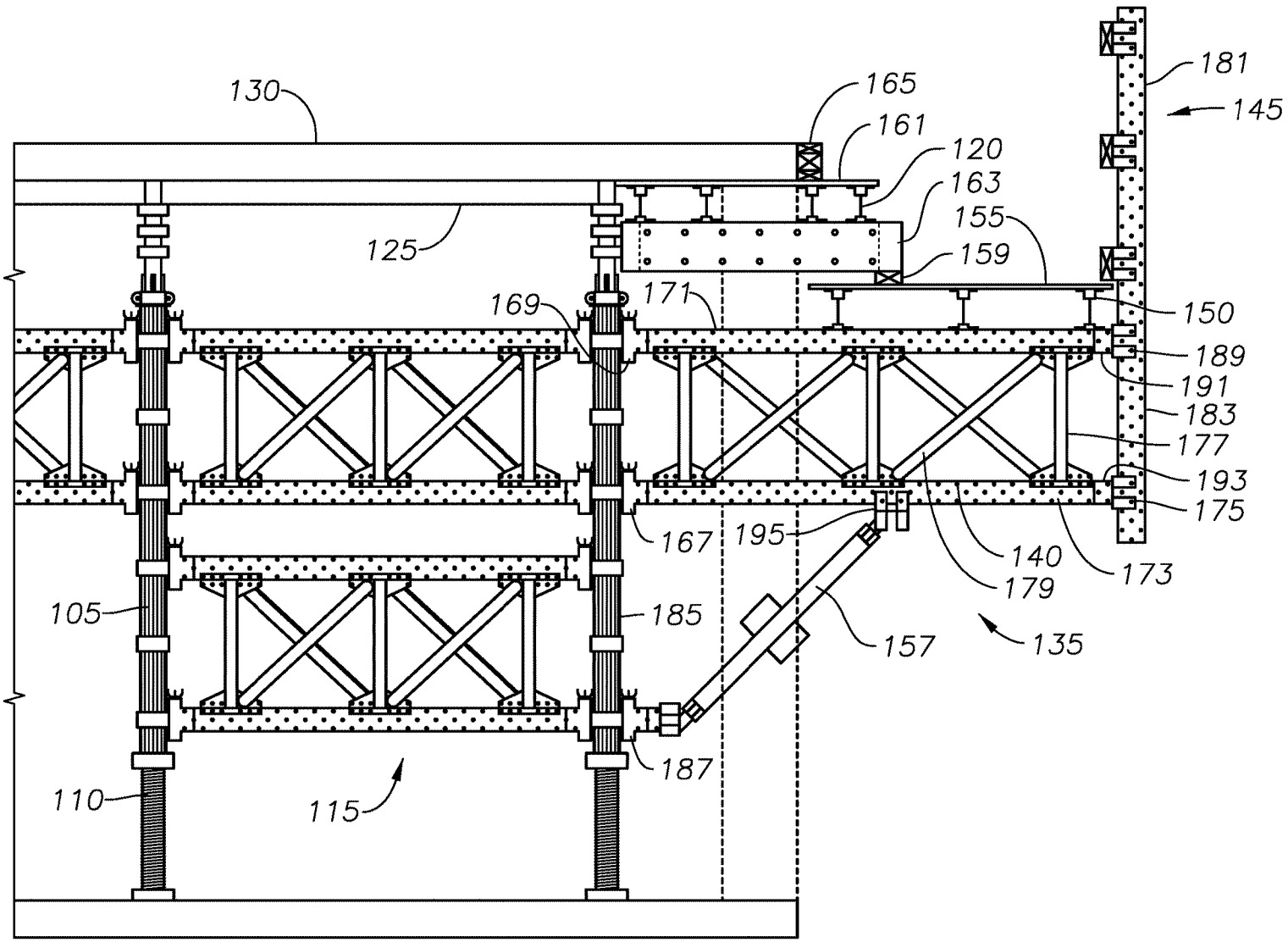
FIG. 1 illustrates a shoring system using components of an integrated construction system in accordance with implementations of various techniques described herein.

The integrated construction system of the present disclosure was designed to rectify many of the shortcomings conventional systems, including to further reduce the amount of components needed and maintain a high degree of versatility. In addition, the present integrated construction system is primarily built from non-welded lightweight aluminum components, with minimal steel items used for various fittings and connectors.

As stated above, prior art forming and shoring systems were designed to be independent. Besides the integrated construction system described in the present disclosure and the system disclosed in Applicant's related co-pending U.S. patent application Ser. No. 15/630,923, which is herein incorporated by reference, there is no integrated system disclosed in the prior art where standard elements of the integrated system can be used in both a formwork system configuration and a shoring system configuration. The present integrated construction system functions as one complete system for both vertical and horizontal aspects of concrete construction. The present integrated construction system can also be configured to provide a heavy-duty access or scaffolding system.

The present disclosure provides a shoring system that is part of a larger integrated construction system. This shoring system includes several key unique features that are not found in similar systems currently available in the market. These unique features are outlined below.

None of the prior art individual construction systems provides a system that provides the aspects of formwork, shoring and provision of safe worker access during construction. The present integrated construction system forms part of a complete "construction system" offering that satisfies all three of the aforementioned aspects of construction.

In one implementation, the present integrated construction system provides aluminum extruded posts with mechanically fastened cast fittings. Prior art modular aluminum shoring systems have bracing ledger and base attachment aluminum welded fittings. However, many of the prior art shoring systems do not have ledger fittings and, therefore, do not provide any capacity for the ledgers to carry any appreciable load. The present shoring systems provide post fittings, e.g., cast fittings, ledger fittings or fitting rings, attached with mechanical fasteners that are designed to carry loads for multiple situations.

In one implementation, the present integrated construction system provides a multipurpose aluminum and steel modular ledger. The ledgers may be made from a hybrid of aluminum and steel components vs. welded aluminum.

The ledgers can be configured into a variety of assemblies for a multitude of applications vs. static sized bracing panels. The ledgers are designed to act as a truss or load bearing member (e.g., vertical or other types of loads) vs. being used solely as a bracing and spacing member.

The ledger post connections have a removable series of end connections for various uses. The ledger post connections are not permanently mounted and are designed for multiple purposes as opposed to being designed for a single purpose.

The modular ledger is designed to be useable as: a bracing/spacing panel between vertical posts; a headload or truss shoring member that can hold up shoring loads in a variety of situations; an access platform for vertical shearwall construction; a roof truss system for large enclosures; and a perimeter safety deck system for construction worker access.

In one implementation, the present integrated construction system provides safety deck solutions for worker access. Safe construction worker access is an important aspect of all high-rise concrete construction projects. The present integrated construction system provides safe worker access to the outer perimeter of floor slab construction during all phases of: a floor pour, shoring setup, slab pour, post-tensioning slab cables, and continuous setup of the next level of shoring. Prior art systems use the actual slab shoring structure to give workers access to the perimeter of the top floor under construction. The problem with the prior art is that once the shoring is stripped, there is no effective means of access to the outer perimeter of a previously constructed floor slab. The issues present in prior art worker access slow down the construction cycle. The present integrated construction system provides perimeter deck access that is provided using components of the integrated construction system but independent of the shoring deck itself, to give worker access to the outer perimeter of the work. This allows the lower level access to remain in place to allow workers continued perimeter access to lower levels, while the upper level construction continues.

In one implementation, the present integrated construction system provides applications for heavy duty access. Conventional scaffolding systems are generally used to give workers access to general construction tasks. However, when the applications become extremely high or when the system incurs higher than normal loading conditions, other means of worker access are generally required. The present integrated construction system is able to provide worker access in higher than normal loading situations, while still meeting all OSHA access regulations.

In one implementation, the present integrated construction system provides heavy duty enclosures. Enclosures or containment structures are a common form of providing environmentally controlled spaces when critical construction processes require weather or other forms of climate protection. When these enclosure structures become large or subjected to high external forces, such as wind, most conventional scaffolding systems do not have the ability to perform in these high external force conditions. The present integrated construction system is able to sustain higher than normal loads and can be configured to provide larger than normal containment structures.

In one implementation, a mega-shore application is provided. Most prior art shoring systems have either a light or medium duty rating. Other prior art shoring systems may have heavy or very heavy-duty ratings. No prior art system can function across all rating ranges. Posts coupled to a mega-shore bearing plate can be configured in a variety of ways to achieve each level of duty rating. This includes the ability to cluster posts in groups to achieve very high loads in excess of 100,000 lbs. per shore location.

FIG. 1 shows a configuration providing a shoring application using components of an integrated construction system. FIG. 1 shows primary shoring components: aluminum posts 105, aluminum adjustable screw legs 110, aluminum and/or steel ledger assemblies 115, aluminum header beams (not shown), and aluminum joists 120. The primary components are constructed and assembled together without using any aluminum welding. The primary components of the shoring configuration are designed for multiple uses and are also designed for integration with formwork components of the integrated construction system. For example, the 6 foot panels 125 used to form slab 130 are configured for use in both formwork and shoring applications. As detailed further below, other components in addition to the primary components are included to provide additional applications for roll-back formwork, mega-shoring, perimeter safety deck systems, and heavy duty access systems.

An example of a perimeter safety deck system 135 is also shown in FIG. 1. This example perimeter safety deck for worker access includes a ledger assembly 140 and a plurality of ledger rails coupled together to form an outer wall 145 (although multiple ledger rails 181, 183 are shown in this example, a single ledger rail may also be used to form the outer wall). In this example, ledger assembly 140 includes ledger rails 171, 173 and includes struts 177 and brace members 179. The ledger assembly 140 is coupled to post 185 using ledger clamps 167, 169. Ledger assembly 140 is coupled to ledger rails 181, 183 using ledger end fittings 191, 193 and accessory clips 175, 189. Ledger assembly 140 may be supported by bracing element 157. Bracing element 157 may be coupled to ledger 173 using an accessory clip 195. Bracing element 157 may also be coupled to the post 185 using ledger clamp 187. Although a plurality of struts 177 and brace members 179 are shown, certain implementations may include or omit ledger 140, struts 177 and brace members 179.

Although the ledger assembly includes multiple ledger rails 171, 173, certain implementations may include only one horizontal ledger rail, e.g., ledger rail 171, coupled to post 185 and outer wall 145. In implementations where bracing is utilized, ledger rail 171 may be supported by bracing element 157. In this implementation, bracing element 157 can be coupled directly to ledger rail 171 using clip 195 and coupled to a fitting of post 185 using clamp 187.

In the example shown in FIG. 1, joists 150 are coupled to the bracing assembly and are used to support a platform 155, e.g., a wood platform. Platform 155 may provide support for shoring in addition to providing worker access via a perimeter safety deck. Platform 155 may support a modular header beam 163 coupled to joists 120, which in turn support a platform 161 and barrier 165. The platform 161 and barrier 165 are used to form an outer edge of the concrete slab 130. In some implementations filler 159 may be included to keep modular header beam 163 and platform 161 level.

Joists 120, 150 may be coupled to a modular header beam or a ledger rail (e.g., modular header beam 163 or ledger rail 171) using a metal clip that holds a nut and bolt. The head of the bolt slides into a groove along the bottom of the joist 120, 150 and the metal clip connects to either the modular header beam or the ledger rail/panel. Once the clip is in place, the bolt is tightened to connect both members (the joist and the modular header beam or the ledger rail) together.

Figure 30:
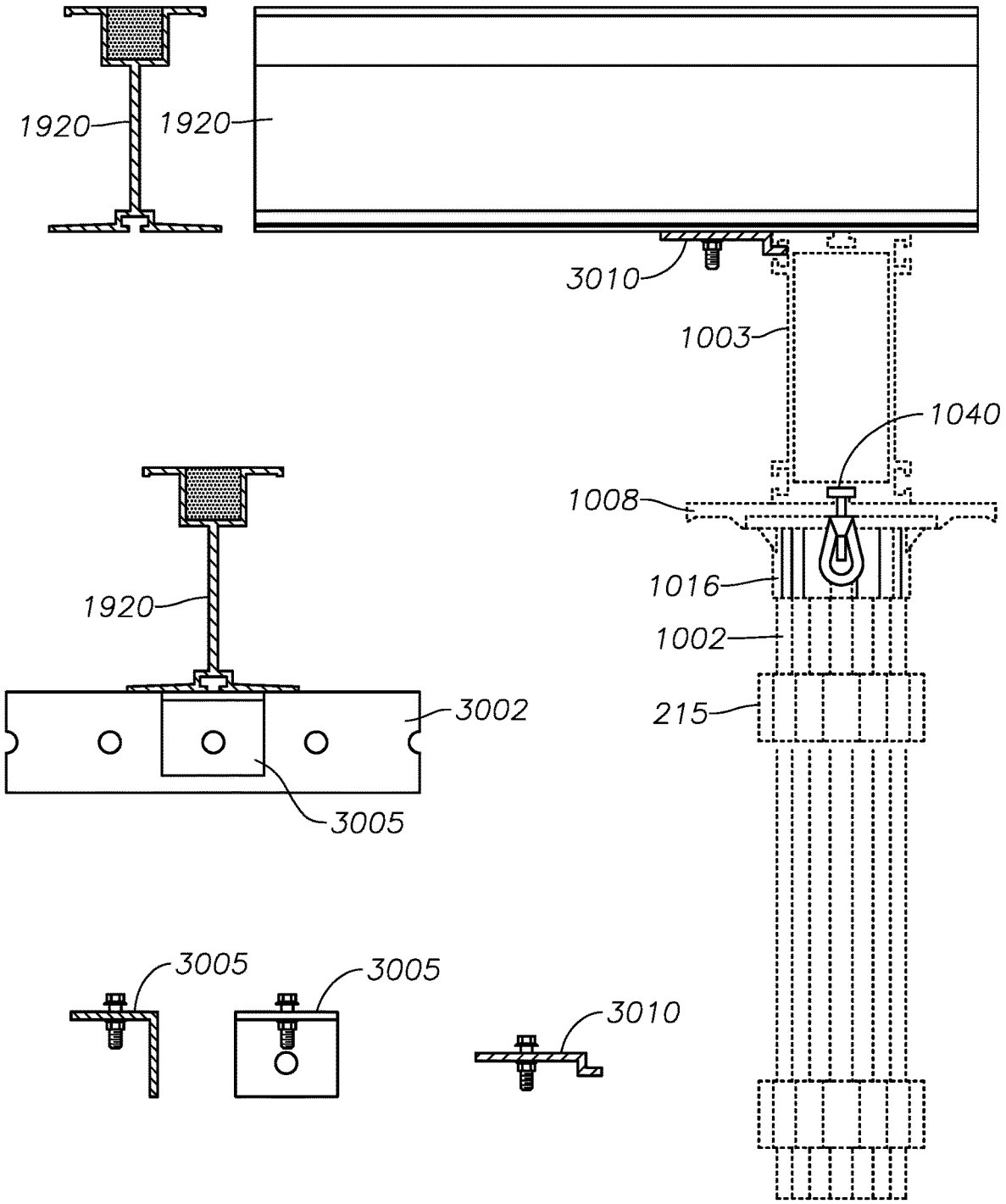
FIG. 30 illustrates a coupling of a joist to a modular header beam in accordance with implementations of various techniques described herein.

The coupling of a joist to a modular header beam is shown in more detail in FIG. 30. FIG. 30 shows a joist 1920 coupled to a shoring assembly 3001 that includes a modular header beam (header extrusion 1003), multi-purpose bearing plate 1008, eye-bolt connector 1040, post end fitting 1016, and a post 1002 having post end fittings 215. Joist 1920 is coupled to the shoring assembly 3001 using standard joist clip 3010 as described above.

The coupling of a joist to a ledger is also shown in more detail in FIG. 30. FIG. 30 shows a joist 1920 coupled to a modular ledger panel 3002 using joist/ledger clip 3005.

Figure 2:
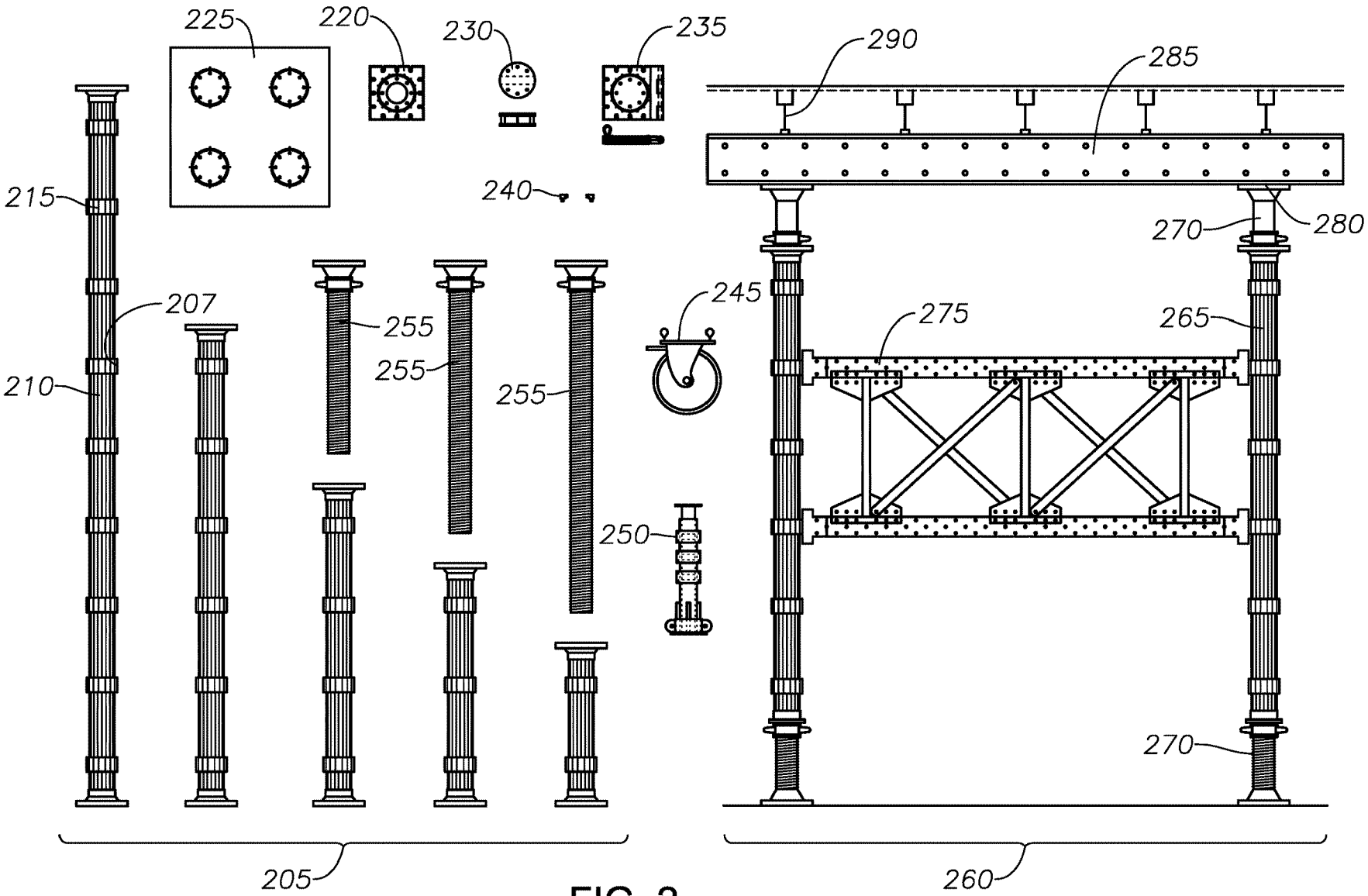
FIG. 2 illustrates various system component drawings for modular vertical posts and post components in accordance with implementations of various techniques described herein.

FIG. 2 includes various system component drawings for modular vertical posts 205 that include post components 210, 215 of the shoring system. The modular vertical posts 205 may be provided in various lengths. In one implementation, the modular vertical posts 205 have lengths of 2 feet, 3 feet, 4 feet, 6 feet and 9 feet. Each of the posts 205 is made up of a longitudinal extruded post 210 and independent fittings, e.g., ledger fitting 215, that are fastened to the post. The independent fittings are not welded to the post. The independent fittings are, instead, mechanically fastened. The fittings are coupled to the post by sliding the fitting down the post, twisting the fitting into place and mechanically fastening the fitting to the post. The fitting is twisted into place using a groove 207 lathed into the ribs of the post 205. The groove 207 is obscured by the fitting 215. Fittings are placed onto the post at predetermined intervals. In one implementation, fittings fastened to the post are placed 12 inches apart.

Figure 29:
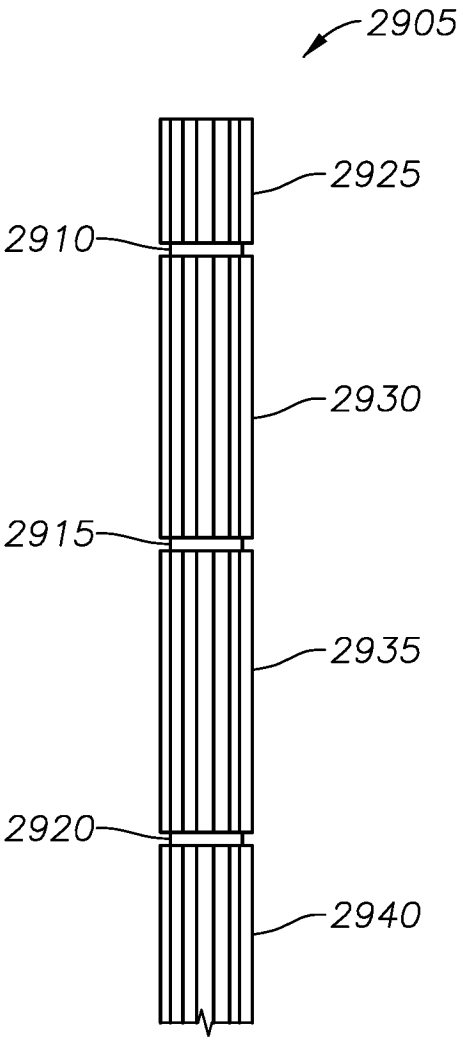
FIG. 29 illustrates a post in accordance with implementations of various techniques described herein.

FIG. 29 illustrates a post without fittings. Post 2905 includes ribbed portions 2925, 2930, 2935, 2940 and grooves 2910, 2915, 2920. The post is formed as a longitudinal extrusion having ribs. The grooves 2910, 2915, 2920 are lathed/cut into the ribs of the post 2905 at predefined intervals resulting in the post having the grooves 2910, 2915, 2920 and the ribbed portions 2925, 2930, 2935, 2940. As described above, the fittings are coupled to the post by sliding them down the ribbed portions 2925, 2930, 2935, 2940 of the post. The fittings are then twisted into place using grooves 2910, 2915, 2929.

Screw legs 255 are provided in various lengths and are used to adjust a height of the vertical post. The height of the post may be adjusted by using the screw legs on one or both ends of the vertical post. The bearing plate 220, mega-shore bearing plate 225, slope bracket 230, post hinge 235, screw leg connector clips 240, swivel caster shoe 245, and deck drophead 250 are used with the vertical posts to provide various shoring application configurations. FIG. 2 further includes a side view of one configuration of a shoring assembly 260 using vertical posts 265, screw legs 270, the ledger panel assembly 275, bearing plates 280, a header beam 285, and joists 290.

Figure 3:
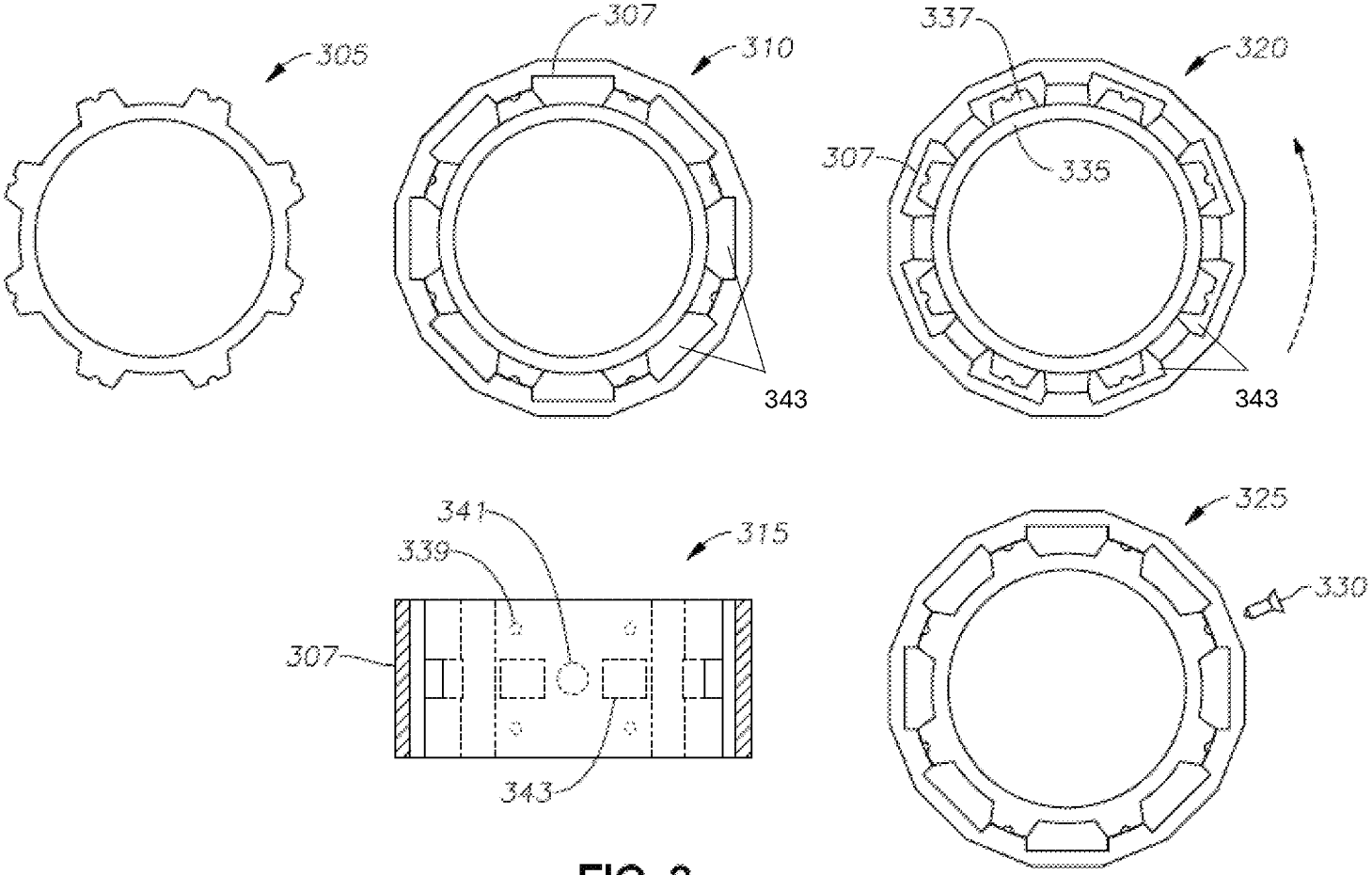
FIG. 3 illustrates details of a post extrusion and a ledger fitting in accordance with implementations of various techniques described herein.

FIG. 3 shows details of a post extrusion, and a ledger fitting. Implementations of the integrated construction system may refer to a modular vertical post (e.g., modular vertical post 210), a post (e.g., post 305) and a post extrusion (e.g., post extrusion 1525) interchangeably. Implementations of the integrated construction system may also refer to a ledger fitting (e.g., ledger fitting 215), a post ledger fitting (e.g., post ledger fitting 1530), and a fitting ring (e.g., fitting ring 307) interchangeably. FIG. 3 shows a cross-sectional view of post 305. Post 305 is an extruded aluminum post. Also shown is a fitting, e.g., fitting ring 307. Fitting ring 307 is used to attach a ledger or ledger assembly to post 305. Ledgers and ledger assemblies are described in more detail below in FIGS. 13-17. In one implementation, the fitting ring 307 is spaced every 12 inches along the post 305.

As also described above in FIG. 3, the fitting ring 307 is slid down the post 305 and then twisted into place on the post 305. After twisting the fitting ring 307 into place on the post 305, the fitting ring 307 is mechanically fastened to the post, e.g., with a screw. The feature is unique to this system, as all others weld connection fittings to the post.

The post 305 is configured to be a complete extruded piece, e.g., constructed of aluminum. The post 305 is cut to a specific length. A groove, e.g., groove, is lathed into the circumference of the post 305 at predetermined locations along the post 305. In one implementation, the groove is lathed into the post 305 every 12 inches. In one implementation, the groove is a 1/2 inch cut groove. The fitting ring 307 slides down the post 305 and twists into place at each groove. View 320 shows the fitting ring 307 being twisted into the groove, which is shown in FIG. 29. View 320 shows a circular shaft portion 335 of the post 305. View 320 also shows an outer rib portion 337 of the post 305 that remains below the groove. The groove is cut on the vertical ribs of the extrusion, not on the circular shaft. In one implementation, screws may fasten the fitting ring 307 into place to prevent them from moving.

View 310 and 315 are top and side views of the fitting ring 307, respectively. As previously described, the rings are twisted into place as shown in view 320 and mechanically fastened as shown in view 325, e.g., using screw 330. As illustrated in FIG. 3, the fitting ring 307 includes protrusions 343 that are intermittently spaced around the inner portion of the fitting ring 307.

As shown in FIG. 29, there are grooves 2910, 2915, 2920 that are cut into the post extrusion 2905. Protrusion 343 of fitting ring 307 fits into the groove 2910, 2915, 2920. Once fitting ring 307 is placed onto post extrusion 2905, screws 330 are used to hold the fitting ring 307 in place on the post extrusion 2905. The screws 330 that hold the fitting ring 307 in place are seated through hole 339. Optional hole 341 can be used for future attachments, such as lateral plan bracing or cable bracing.

Configuring posts in the manner described above allows for the installation of posts and ledgers without welding. In addition, configuring posts in this manner further allows posts to take a load. Prior art systems don't allow a ledger to put a load from a ledger onto a post.

Figure 4:
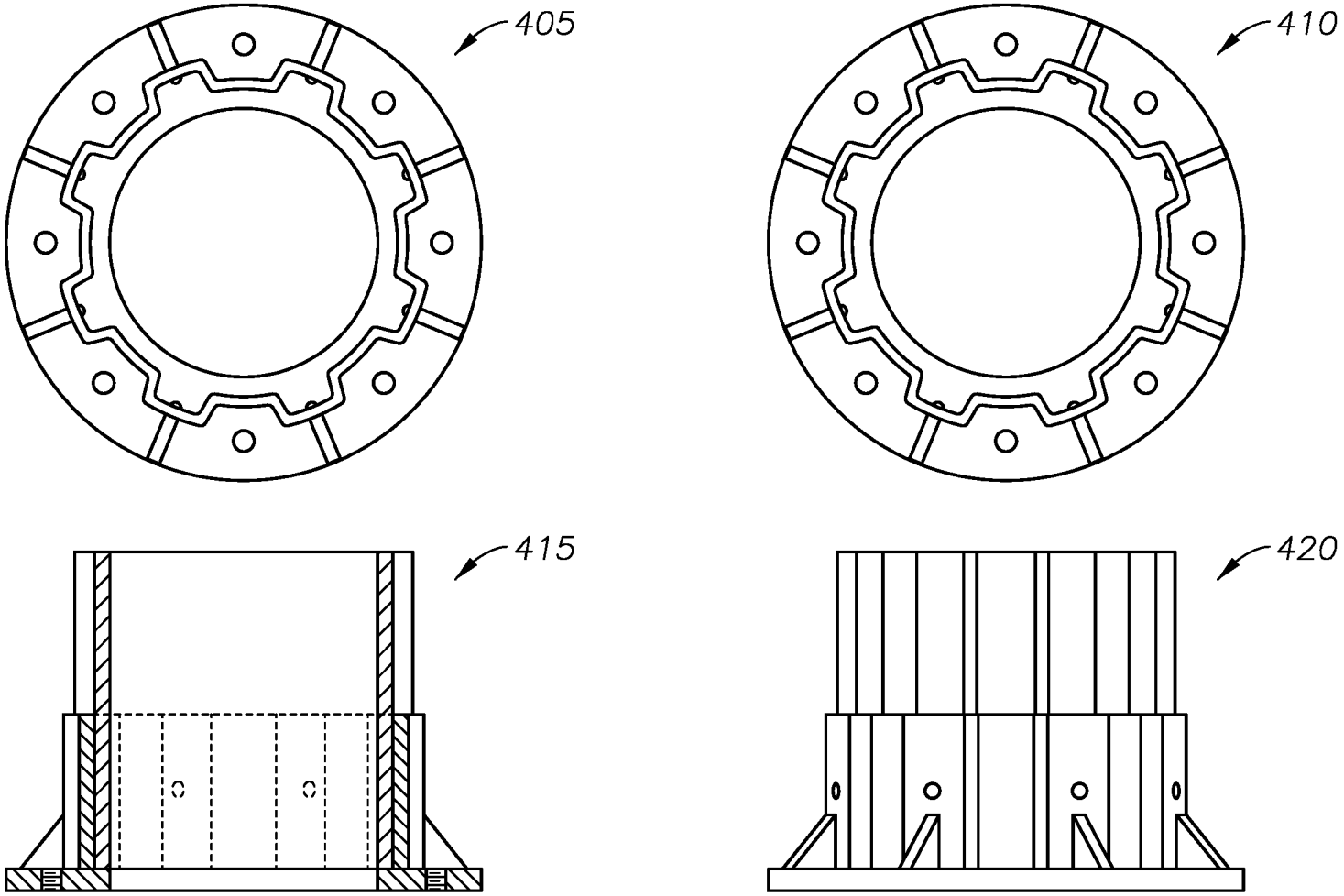
FIG. 4 illustrates various views of a post end fitting in accordance with implementations of various techniques described herein.
Figure 5:
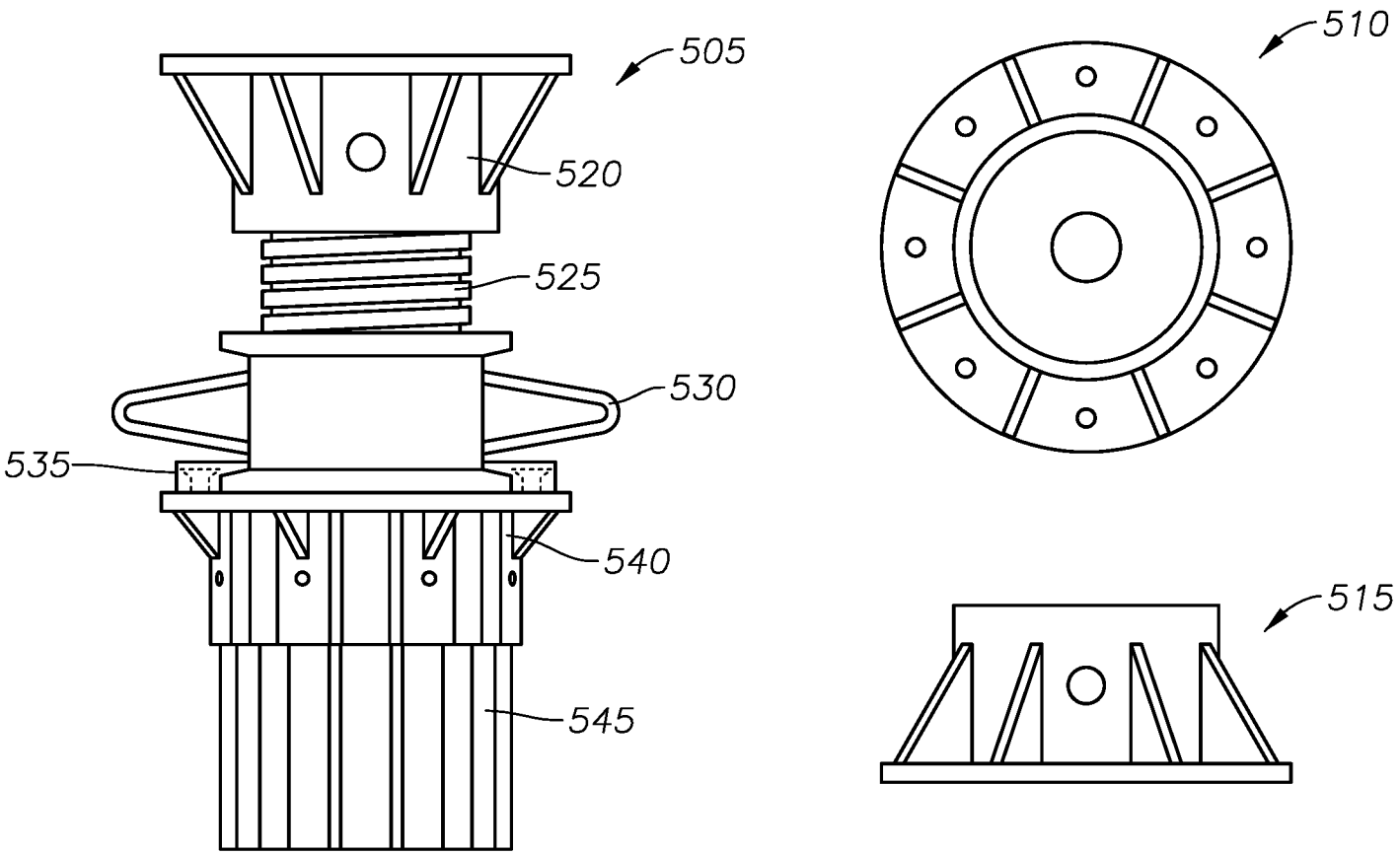
FIG. 5 illustrates various views of screw leg components in accordance with implementations of various techniques described herein.

FIG. 4 and FIG. 5 include post end components. The post end components may include the post end fitting of FIG. 4 and/or the screw leg components of FIG. 5.

FIG. 4 shows various views 405, 410, 415, 420 of a post end fitting. View 405 is a top cross-sectional view of a post end fitting. Views 410, 415, 420 are top cross-sectional, side cross-sectional, and side view respectively, of a post end fitting coupled to a post. The post end fitting can be used on a top portion and a bottom portion of each post. In one implementation, the post end fitting is configured to be a permanent fitting.

FIG. 5 shows various views 505, 510, 515 of screw leg components. One portion of FIG. 5 shows a side view 505 of a post and screw leg assembly. This view shows a screw leg end fitting 520, a screw leg thread 525, a screw leg adjusting nut 530, screw leg connector clips 535, a post end fitting 540, and an aluminum post 545. The screw leg connector clips 535 allow the screw leg 520, 525, 530 to attach to the post end fitting 540 and fly with the post after a pour.

Shoring is generally used repetitively from one concrete pour to the next. In typical prior art shoring systems, the shoring system is completely disassembled and then re-assembled on the next position. The present integrated construction system provides the ability to keep much of the setup intact and fly the assembly with a crane from one setup to the next to reduce labor costs. The screw leg clips allow the screw legs to remain attached to the posts, so the screw legs will still turn for adjustment, but also provide the ability to move the post and screw leg as a unit from one pour to the next without being disassembled.

Another portion of FIG. 5 shows a top view 510 of a screw leg end fitting. Another portion of FIG. 5 shows a side view 515 of the screw leg end fitting. The screw leg assembly 520, 525, 530 is used to vary the height of the shoring assembly, e.g., shoring assembly 260. A portion of the screw leg assembly 520, 525, 530 fits inside of the post 545. Adjustable legs, e.g., screw legs, are used to provide a height needed for a particular application, e.g., within an adjustment range. The screw leg thread 525 is used with a screw leg end fitting 520 and a screw leg adjusting nut 530. In one implementation, the screw leg adjusting nut 530 can be a twisted wing nut. The configuration shown in FIG. 5 allows for an adjustable post having non-welded components.

Figure 6:
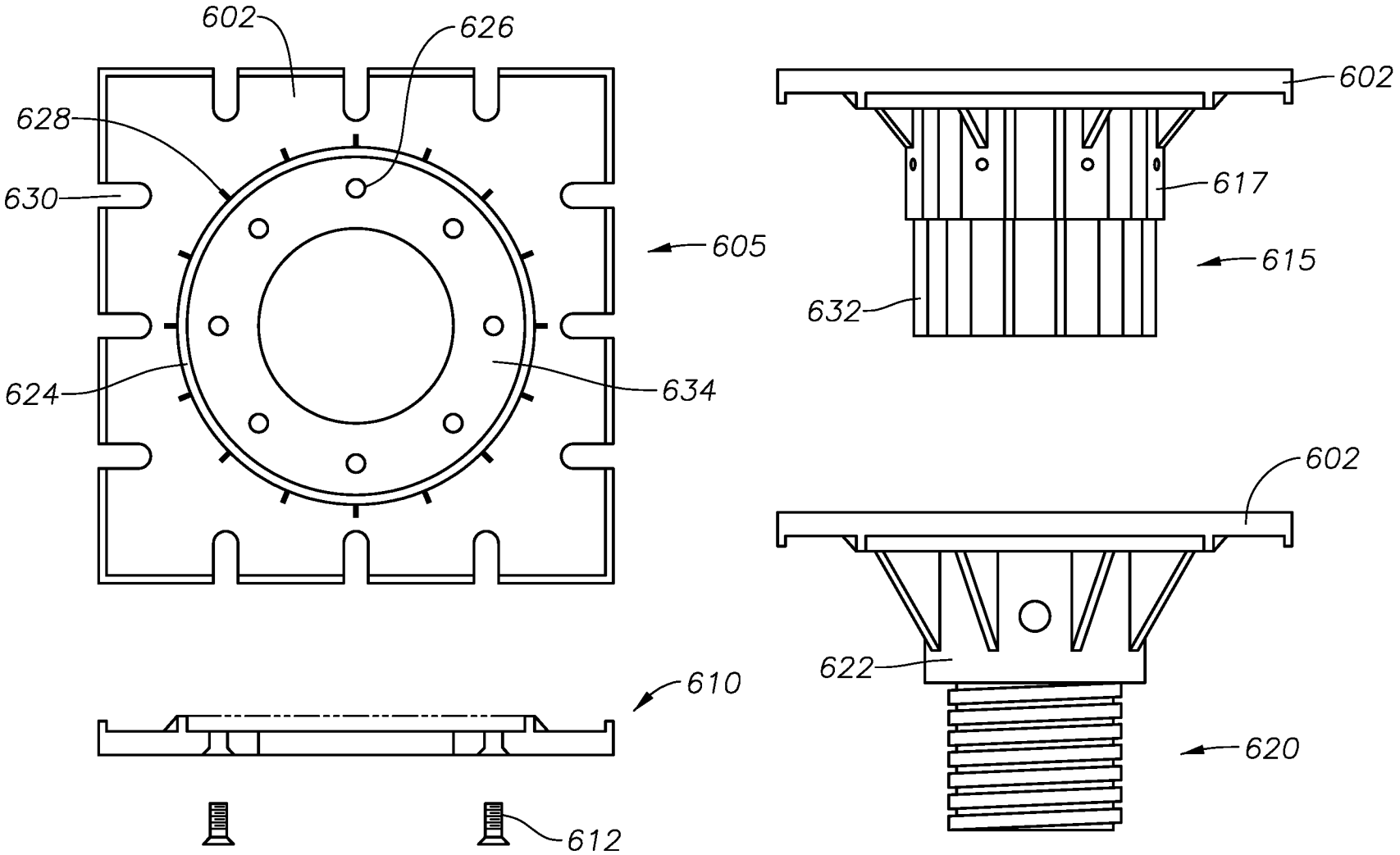
FIG. 6 illustrates various views of a multi-purpose bearing plate in accordance with implementations of various techniques described herein.

FIGS. 6-10 show a multi-purpose bearing plate in various configurations. In one implementation, the multi-purpose bearing plate 602 is constructed of aluminum. The multi-purpose bearing plate may bear on a concrete floor or a sill designed from wood if the shoring assembly is placed over earth fill. FIG. 6 shows various views 605, 610, 615, 620. View 605 is a top view of the multi-purpose bearing plate 602. A top surface of multi-purpose bearing plate 602 has an outer boundary defining an outer edge of the bearing plate. In one implementation, the outer edge includes a plurality of indentations 630. Indentations 630 are used to couple a header beam or other post fittings using a connecting screw. The use of indentations 630 is shown more clearly in FIG. 10 where the eye-bolt connector 1040 is used to couple the multi-purpose bearing plate 602 for various applications. The top surface of multi-purpose bearing plate 602 has an inner boundary 624 within the multi-purpose bearing plate 602 that defines an area 634 shaped to interchangeably accommodate a plurality of components of the integrated construction system. A plurality of members 628 are formed on an outer surface of the inner boundary 624. The plurality of members 628 give added bending capacity between the multi-purpose bearing plate 602 and the post end fitting 617. A plurality of openings 626 are formed within the area 634. The openings 626 are used to couple the multi-purpose bearing plate 602 to other components of the integrated construction system.

View 610 is a side view of the multi-purpose bearing plate and screws 612 that are used to couple the bearing plate 602 to other components of the shoring system. Screws 612 pass through holes 626 and screw into the post end fitting 617 or screw leg end fitting 622. View 615 is a side view of the multi-purpose bearing plate coupled to a post end fitting 617. Post end fitting 617 is coupled to a portion of a post 632. View 620 is a side view of the multi-purpose bearing plate 602 coupled to a screw leg end fitting 622. The multi-purpose bearing plate 602 can be used on a top portion of a shoring assembly and/or a bottom portion of a shoring assembly.

Figure 7:
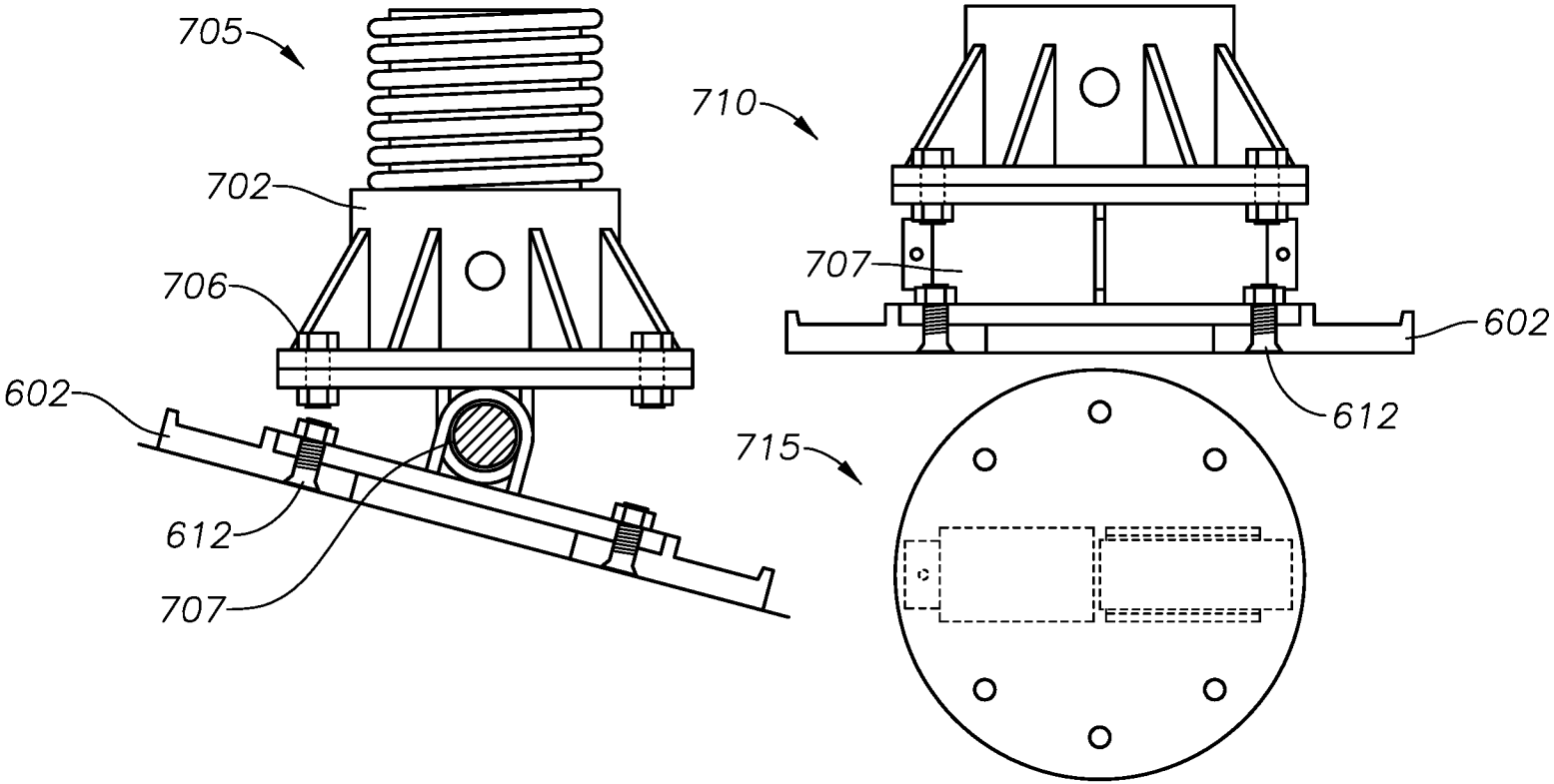
FIG. 7 illustrates various views of a multi-purpose bearing plate in a slope bracket configuration in accordance with implementations of various techniques described herein.

FIG. 7 shows various views 705, 710, 715 of a multi-purpose bearing plate 602 in a slope bracket configuration. The multi-purpose bearing plate 602 is coupled to the slope bracket 707 using screws 612. The slope bracket 707 is also coupled to screw leg 702 using screws 706. View 705 is a view of the slope bracket configuration showing a front/rear portion of the slope bracket 707. View 710 is a view of the slope bracket configuration showing a side view of the slope bracket 707. View 715 is a plan view of the slope bracket. The slope bracket configuration is utilized in sloped surface applications or sloped beam applications.

Figure 8:
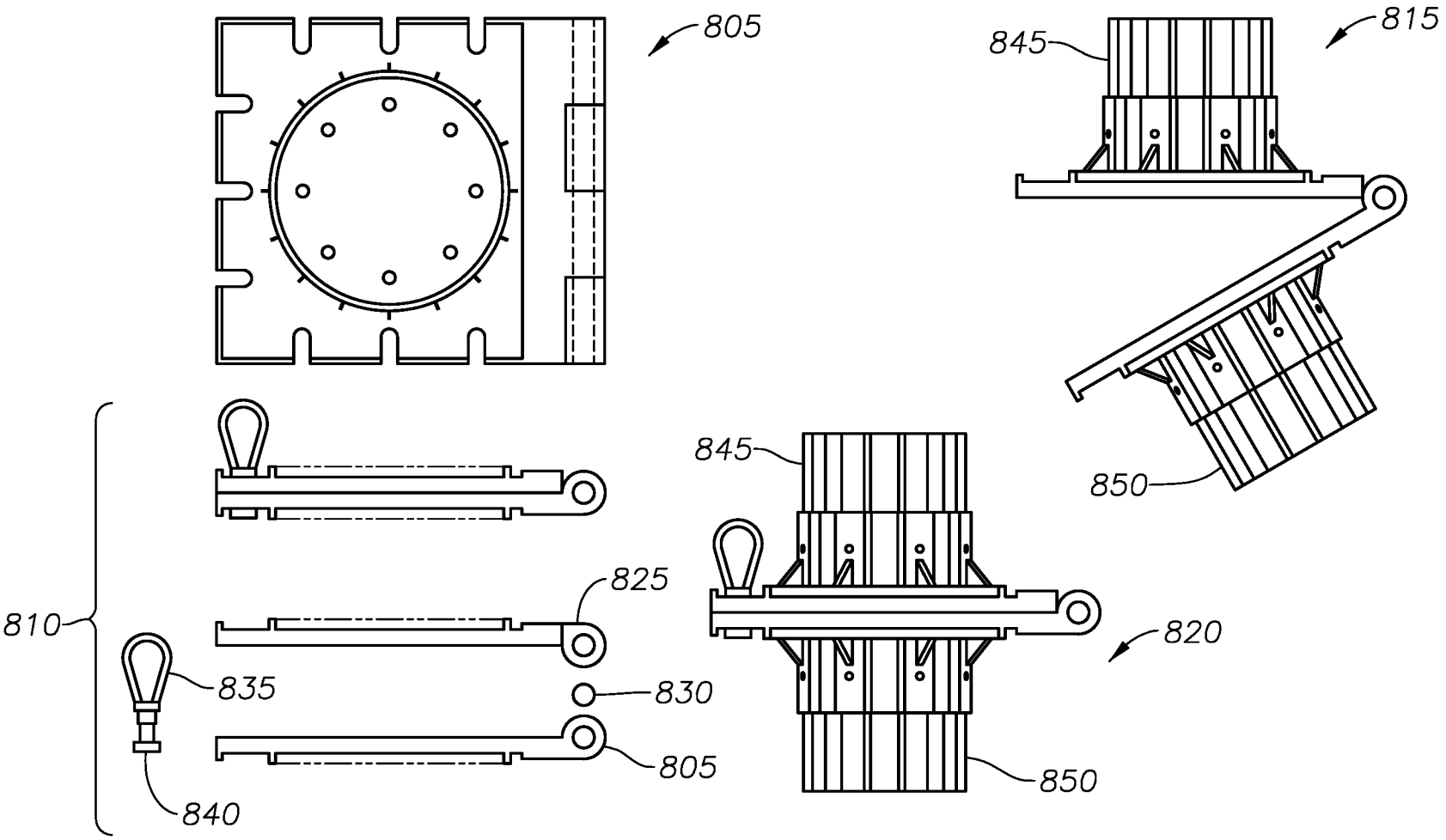
FIG. 8 illustrates various views of a post hinge attachment in accordance with implementations of various techniques described herein.

FIG. 8 shows various views of a post hinge attachment. View 805 shows a bottom plate of a post hinge assembly. View 810 shows a post hinge assembly, which includes a top plate 825, the bottom plate 805, a barrel 830, and a screw fastener 835 and screw 840. View 815 shows the post hinge assembly with posts 845, 850 in an open state. View 820 shows the post hinge assembly with posts 845, 850 in a closed state. The post hinge assembly is useful in moving shoring components.

Figure 9:
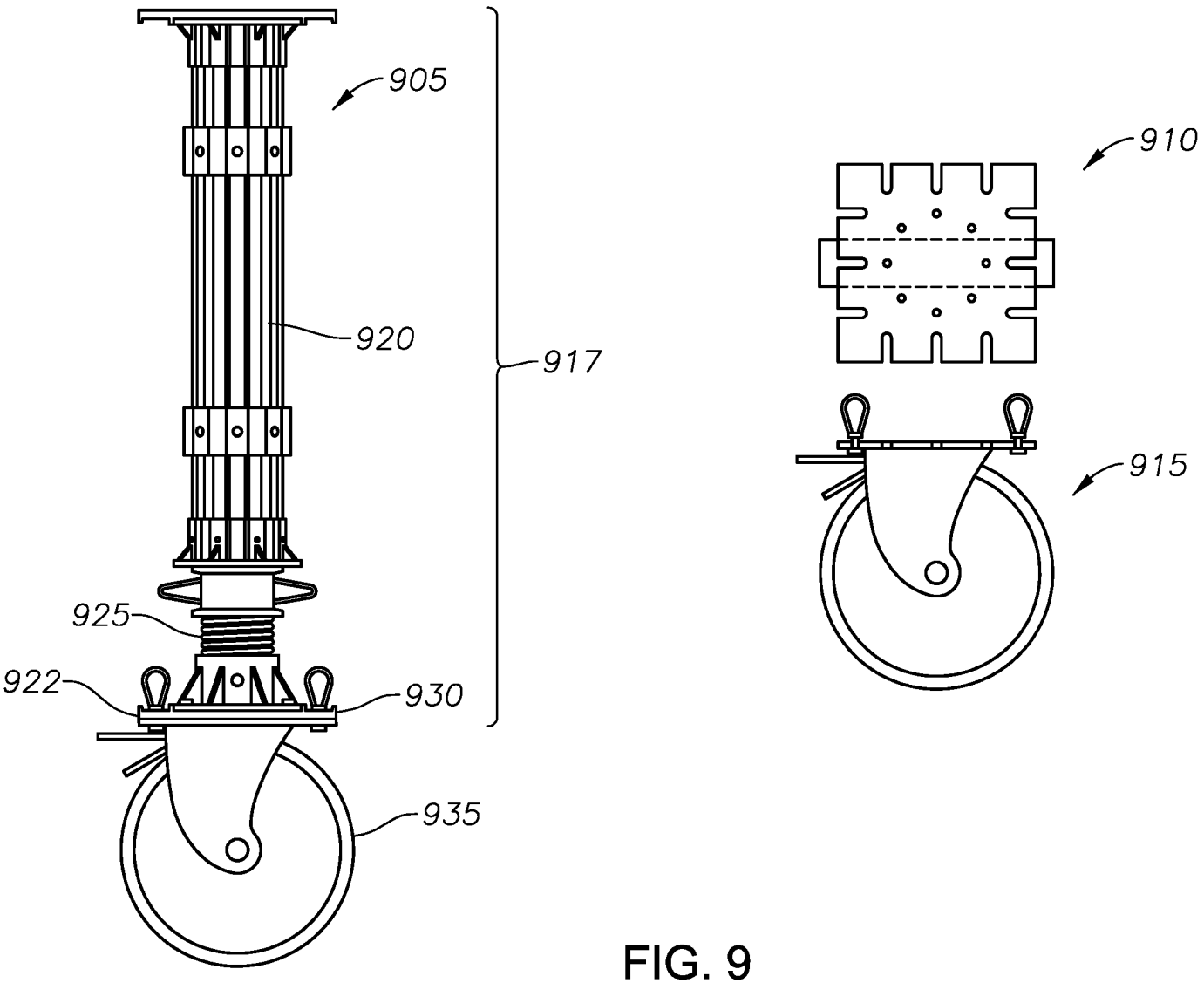
FIG. 9 illustrates various views of a swivel caster shoe in accordance with implementations of various techniques described herein.

FIG. 9 shows various views 905, 910, 915 of a swivel caster shoe. Swivel caster shoes can be mounted to a post assembly 917 using the multi-purpose bearing plate 922. View 905 shows one implementation of a swivel caster shoe 935 coupled to a post assembly 920 and a screw leg assembly 925 using a multi-purpose bearing plate 930. View 910 is a top view of the swivel caster shoe. View 915 is side view of the swivel caster shoe.

Figure 10:
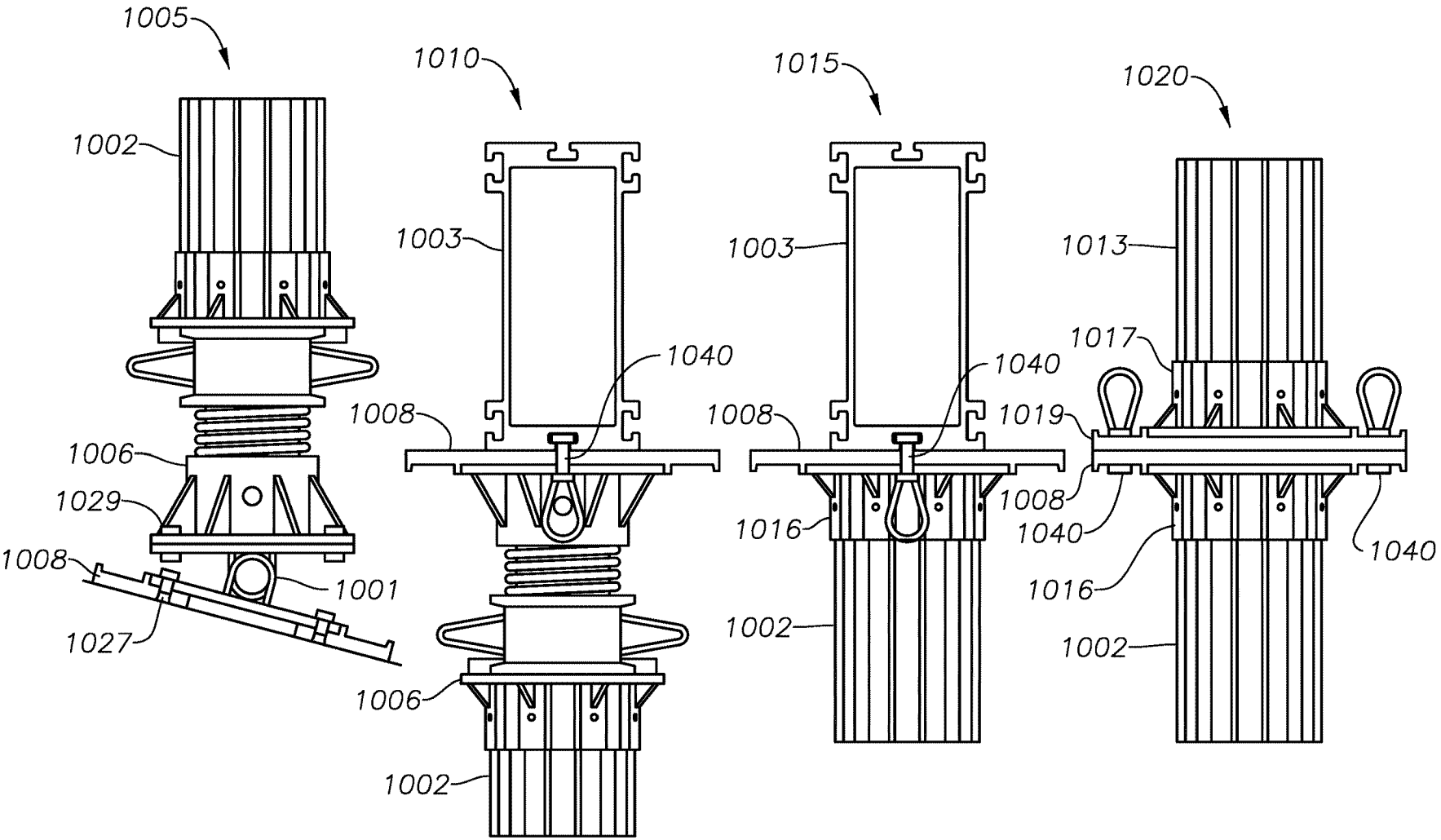
FIG. 10 illustrates different standard post assembly applications using the multi-purpose bearing plate in accordance with implementations of various techniques described herein.

FIG. 10 shows views 1005, 1010, 1015, 1020 of different standard post assembly applications using the multi-purpose bearing plate. In other words, the same multi-purpose bearing plate can be used for different applications. The prior art uses different bearing plates for different applications.

View 1005 shows a sloped slab application. In one implementation, the sloped slab application includes a slope bracket 1001. The slope bracket 1001 is coupled to multi-purpose bearing plate 1008 using screws 1027. Slope bracket 1001 is also coupled to screw leg 1006 using screws 1029. Screw leg 1006 is further coupled to post 1002.

View 1010 shows a screw leg and header beam application. In this configuration, screw leg 1006 is coupled to post 1002. Screw leg 1006 is also coupled to multi-purpose bearing plate 1008, e.g., using screws 1027 (not shown). Multi-purpose bearing plate 1008 is coupled to header extrusion 1003 using eye-bolt connector 1040.

View 1015 shows an application where a header beam is directly coupled to the post. In this configuration, post 1002 is coupled to post end fitting 1016. Post end fitting 1016 is also coupled to multi-purpose bearing plate 1008, e.g., using screws 1027 (not shown). Multi-purpose bearing plate 1008 is coupled to header extrusion 1003 using eye-bolt connector 1040.

View 1020 shows an application where two posts are coupled together. In this configuration, post 1002 is coupled to post end fitting 1016. Post end fitting 1016 is also coupled to multi-purpose bearing plate 1008, e.g., using screws 1027 (not shown). Post 1013 is coupled to post end fitting 1017. Post end fitting 1017 is also coupled to multi-purpose bearing plate 1019, e.g., using screws 1027 (not shown). Multi-purpose bearing plate 1008 is coupled to multi-purpose bearing plate 1019 using eye-bolt connector 1040.

As shown in the various views, the modular posts can be used with the same multi-purpose bearing plate to provide different applications.

Figure 11:
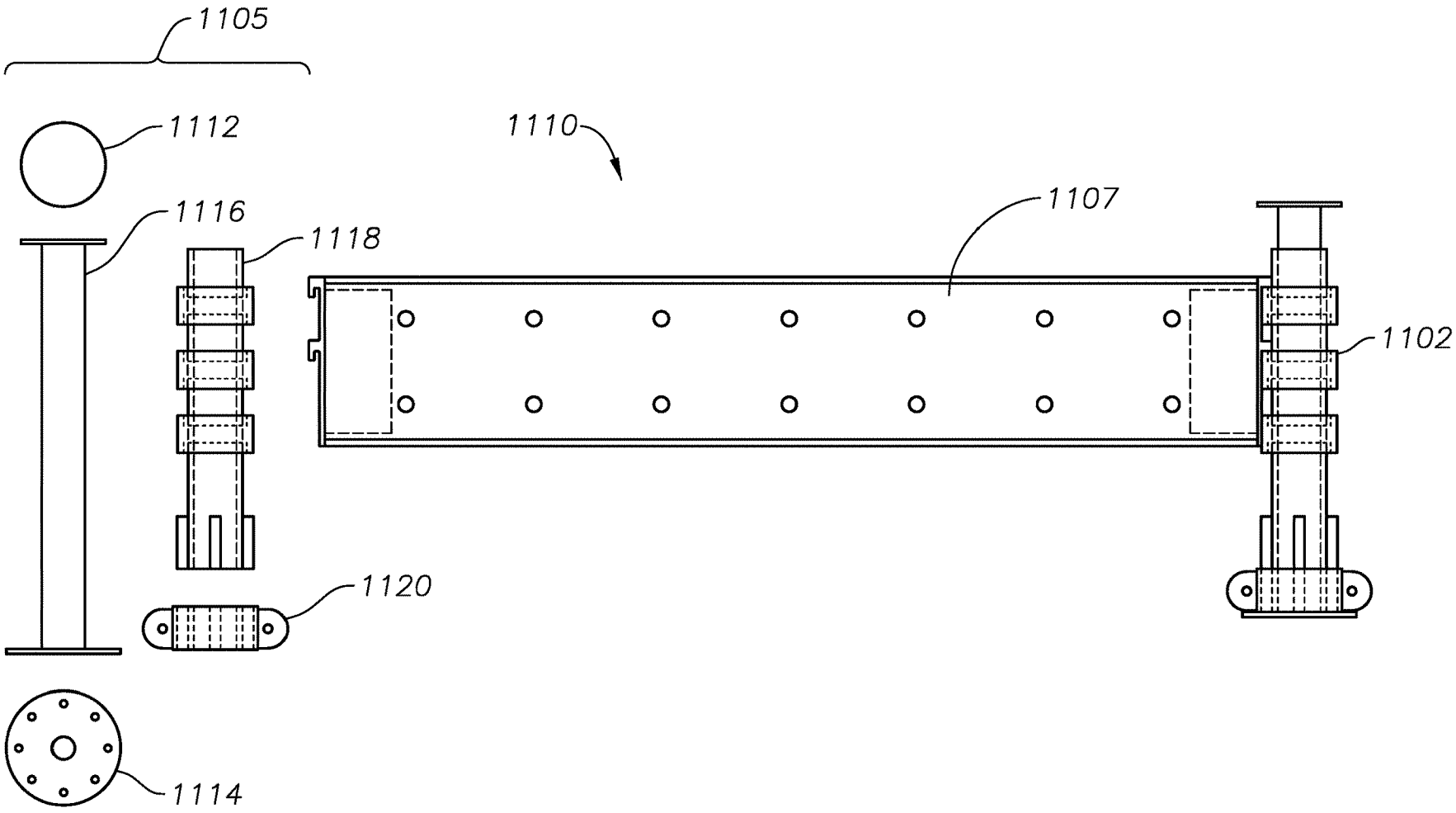
FIG. 11 illustrates drophead components and a configuration showing a drophead coupled to a modular ledger beam in accordance with implementations of various techniques described herein.

FIG. 11 shows drophead components 1105 and a configuration 1110 showing a drophead 1102 coupled to a modular ledger beam 1107. Drophead components 1105 include a drophead top plate 1112, a drophead base plate 1114, a drop head inner tube 1116, a drop head header seat 1118, and a drophead stripping nut 1120. The drophead 1102 provides the ability to drop the shoring and leave the posts in place for reshoring. The drophead components mount to the end of a post or screw leg.

Figure 12:
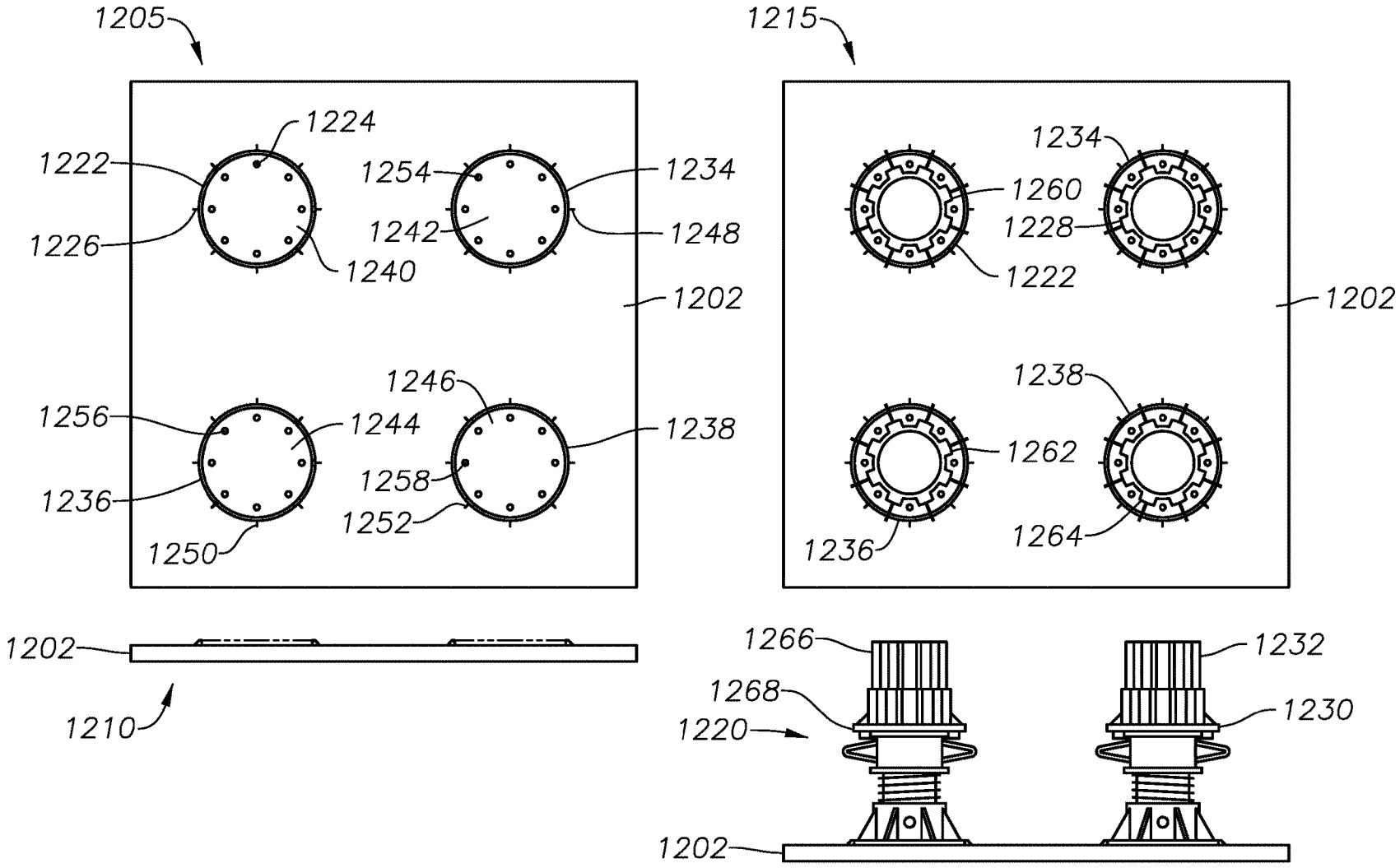
FIG. 12 illustrates various views of a heavy duty or mega-shore bearing plate in accordance with implementations of various techniques described herein.

FIG. 12 shows various views 1205, 1210, 1215, 1220 of a heavy duty or mega-shore bearing plate. View 1205 is a top view of a mega-shore bearing plate 1202. In one implementation, the mega-shore bearing plate 1202 is constructed of steel. The mega-shore bearing plate 1202 may be coupled to a beam or a modular header beam (e.g., modular header beam 1912) near a top portion of a shoring assembly using a metal clip, e.g., standard joist clip 3010. A top surface of mega-shore bearing plate 1202 has an outer boundary defining an outer edge of the bearing plate. The top surface of mega-shore bearing plate 1202 has a plurality of inner boundaries 1224, 1234, 1236, 1238 within the multi-purpose bearing plate 1202. Each inner boundary 1224, 1234, 1236, 1238 defines an area 1240, 1242, 1244, 1246 shaped to interchangeably accommodate a plurality of components of the integrated construction system. A plurality of members 1226, 1248, 1250, 1252 are formed on an outer surface of each inner boundary 1224, 1234, 1236, 1238. The plurality of members 1226, 1248, 1250, 1252 are the seats where the post end fittings, e.g., post end fitting 617, are mounted to the mega-shore bearing plate 1202, e.g., using screws 612. A plurality of openings 1224, 1254, 1256, 1258 are formed within each area 1240, 1242, 1244, 1246. The openings 1224, 1254, 1256, 1258 are used to couple the bearing plate 1202 to other components of the integrated construction system.

View 1210 is a side view of the mega-shore bearing plate 1202. View 1215 is a top view of the mega-shore bearing plate 1202 with posts 1228, 1260, 1262, 1264 installed within areas 1222, 1234, 1236, 1238, respectively. View 1220 is a side view of the mega-shore bearing plate 1202 with posts 1232, 1266 and screw legs 1230, 1268 installed.

The mega-shore or heavy duty bearing plate is used to cluster legs together to handle a very heavy duty load. The heavy duty bearing plate may also be referred to as a high capacity bearing plate. The mega-shore bearing plate accommodates more than one post. In one implementation, the mega-shore bearing plate can accommodate a cluster of four posts.

Figure 13:
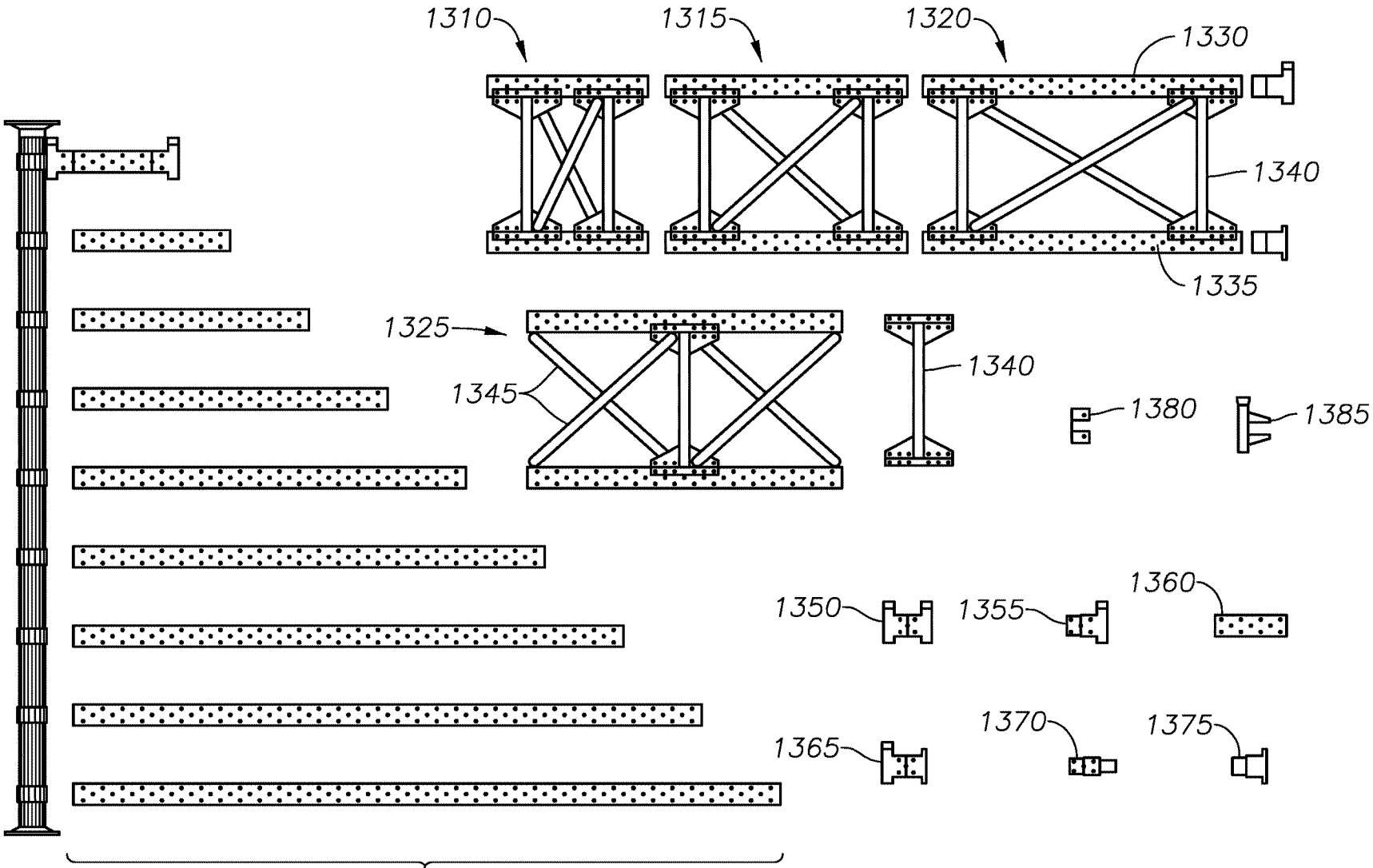
FIG. 13 illustrates various system component drawings for modular ledger panel components in accordance with implementations of various techniques described herein.

FIGS. 13-17 show various configurations for modular ledger panels. FIG. 13 includes various system component drawings for modular ledger panel components. Aluminum ledger rails 1305 of various lengths are shown. The aluminum ledger rails are hollow and can be from 1 foot to 9 feet long. Each ledger rail 1305 includes a plurality of holes placed longitudinally along each side of the rail. The plurality of holes are placed along the rail in a hole pattern. The hole pattern allows other components, e.g., bracing components, and assemblies, e.g., bracing assemblies, to be attached to each rail. Bracing components may include one or more ledger struts 1340. In some implementations, bracing components may include more than one ledger strut and at least two ledger brace members. Example bracing assemblies 1310, 1315, 1320, 1325 are also shown. The bracing assemblies include top 1330 and bottom 1335 ledger rails, ledger struts 1340 (e.g., steel ledger struts) and ledger brace members 1345. Also shown is a double ledger clamp assembly 1350 for 12 inch post spacing, a ledger clamp 1355, a ledger splice 1360, a ledger clamp/end assembly 1365, a ledger guardrail fitting 1370, and a ledger end fitting 1375. When end clamps, e.g., ledger clamps 1355, are coupled back to back and coupled to a post on each side, 12 inch spacing is provided from center to center of the posts. Coupling components, e.g., components 1355, 1360, 1370, 1375, may be used to couple the rails 1305 to other components, e.g., rails, posts, and/or assemblies of the integrated construction system. In addition, a standard accessory clip 1380 and a standard clamp 1385, both of which are disclosed in co-pending U.S. patent application Ser. No. 15/630,923, can be used with the ledger rails and bracing assemblies of the present disclosure. Ledger clamp/end assembly 1365 may be used to couple standard accessory clip 1380 or standard clamp 1385 to the end of a ledger. The ledger clamp assembly 1365 includes ledger clamp 1355 and ledger end fitting 1375 mated together. The ledger clamp assembly 1365 and standard accessory clip 1380 can be used for both formwork and shoring applications of the integrated construction system.

In one implementation, the standard accessory clip 1380 and the standard clamp 1385 can be used to connect formwork components to the ledger rail 1305. In one implementation, the standard accessory clip 1380 and the standard clamp 1385 are used for a one-sided formwork application. In one implementation, no ties are used for one-sided formwork. In this implementation, the ledger and posts become the lateral bracing for the formwork panels.

Figure 14:
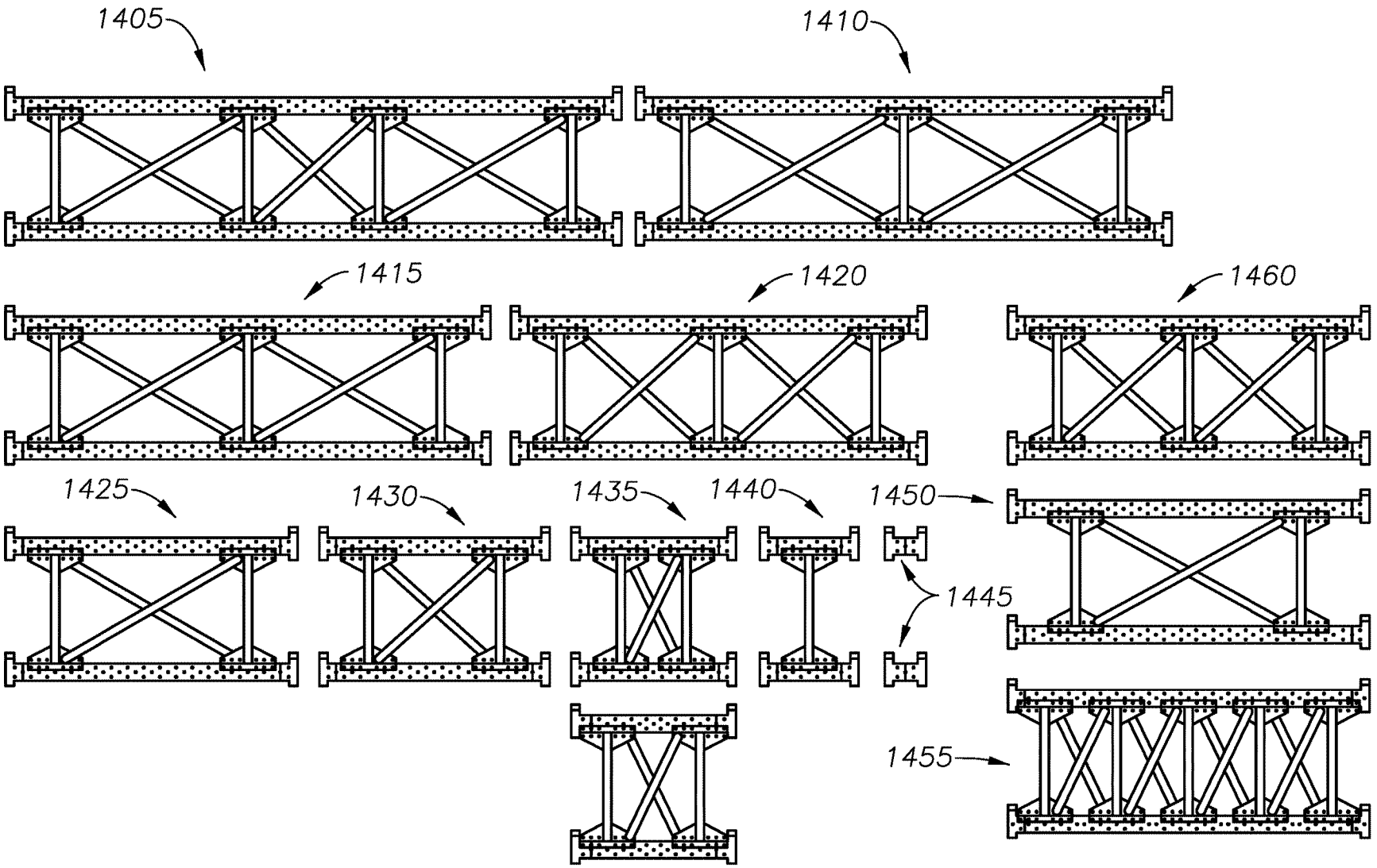
FIG. 14 illustrates various modular ledger configuration examples in accordance with implementations of various techniques described herein.

FIG. 14 shows various modular ledger configuration examples 1405, 1410, 1415, 1420, 1425, 1430, 1435, 1440, 1445, 1450, 1455, 1460. Typical bracing assemblies are shown for various lengths from 1 foot to 10 feet. The bracing assemblies may be configured to accommodate light duty (LD) and heavy duty (HD) configurations. Examples of LD, HD and standard duty configurations are shown in items 1450, 1455 and 1460, respectively. Struts can be added or removed and the cross-brace size can be changed. Load capacity can be adjusted by adding or removing bracing components.

Figure 15:
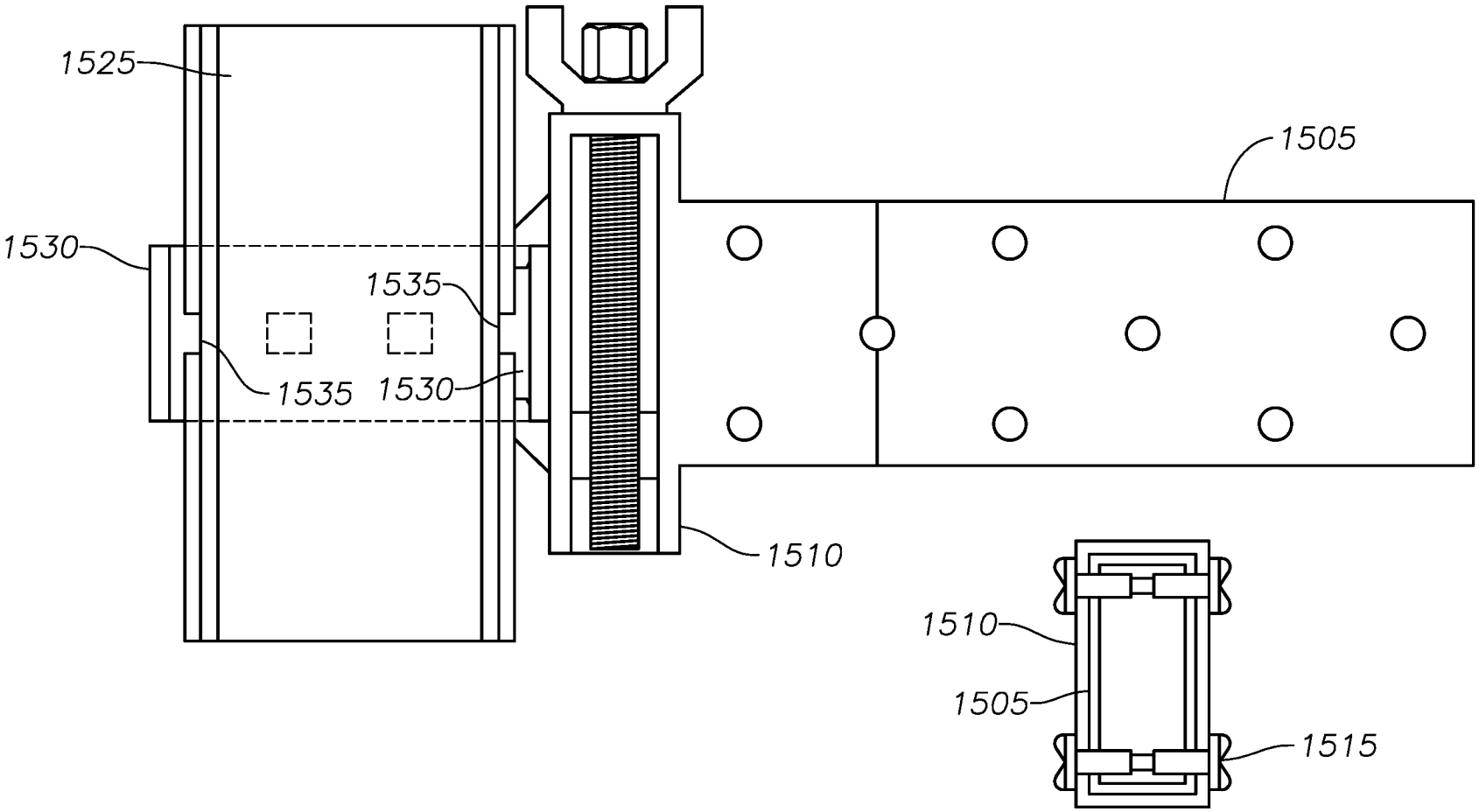
FIG. 15 illustrates a ledger clamp connection in accordance with implementations of various techniques described herein.

FIG. 15 shows a ledger clamp coupled to a post ledger fitting. A ledger rail 1505 is coupled to a ledger clamp 1510 using ledger connectors 1515. The ledger clamp 1510 is coupled to the post extrusion 1525 using a post ledger fitting 307, 1530 that is attached to the post extrusion 1525 using a groove 1535.

Ledger clamp 1510 is part of the ledger assemblies. Ledger clamp 1510 is the same part as coupling component 1355 and is also shown in modular ledger configuration example 1450. The jaws at the end of the ledger clamp 1510 fit over the top and bottom of the post ledger fitting 307, 1530 and tighten in-place using the adjusting screw on the ledger clamp. This connection allows a load to be transferred from the ledger 1505 to the post, via the post ledger fitting 1530.

In configurations where the post 305, 1525 handles a load from a ledger rail, the post 305, 1525 is coupled to a ledger rail 1505 via post ledger fitting 1530 and ledger clamp 1510. The ledger rail 1505 can be configured to act as a truss or a load bearing member (e.g., vertical or other types of loads) when coupled to the post 305, 1525. An inner portion of the post ledger fitting 307, 1530 is configured to be coupled to the post 305, 1525, e.g., using groove 1535 and a mechanical fastener (e.g., screw 330). An outer portion of post ledger fitting 307, 1530 is configured to be coupled to the ledger rail 1505 and configured to allow the post 305, 1525 to handle a load from the ledger rail 1505.

Figure 16:
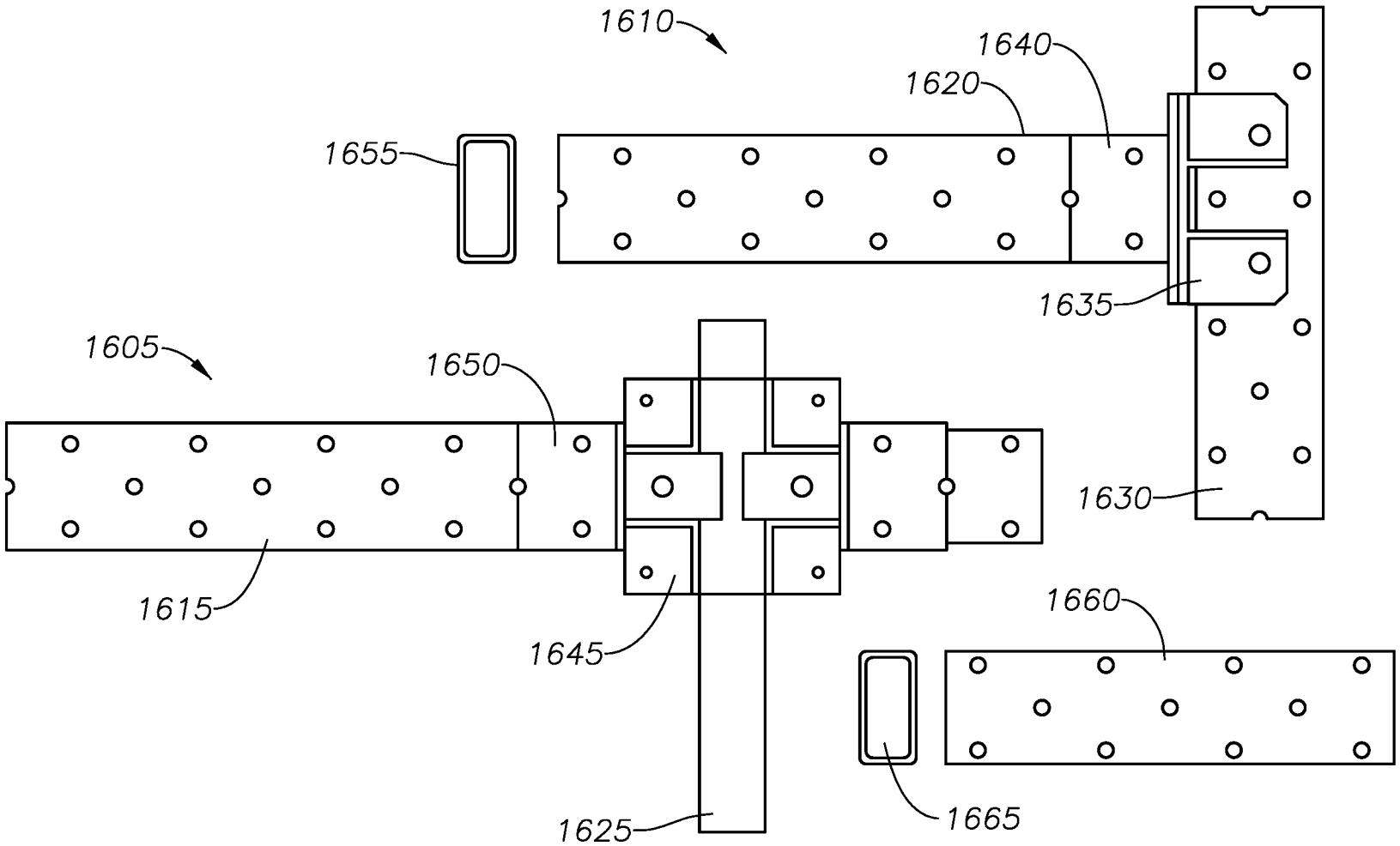
FIG. 16 illustrates ledger rail fittings in accordance with implementations of various techniques described herein.

FIG. 16 shows ledger rail fittings. Views 1605, 1610 show ledger rail fittings clamped together in configurations where a ledger in a horizontal position 1615, 1620 is clamped to a ledger in a vertical position 1625, 1630 using an accessory clip 1635 with an attached ledger end fitting 1640 (view 1605) and a double accessory clip 1645 with an attached guard rail fitting 1650 (view 1610). Also shown is a front/rear view of a ledger tube 1655, a ledger splice 1660, and a front/rear view of a ledger splice 1665.

In one implementation, ledger rail fittings provide the ability to add a vertical guardrail to the end of a cantilevered ledger. In this implementation, the cantilevered ledger is decked for worker access. The ledger rail fittings allow a guardrail to be installed on the perimeter for worker safety, e.g., to prevent falling.

Figure 17:
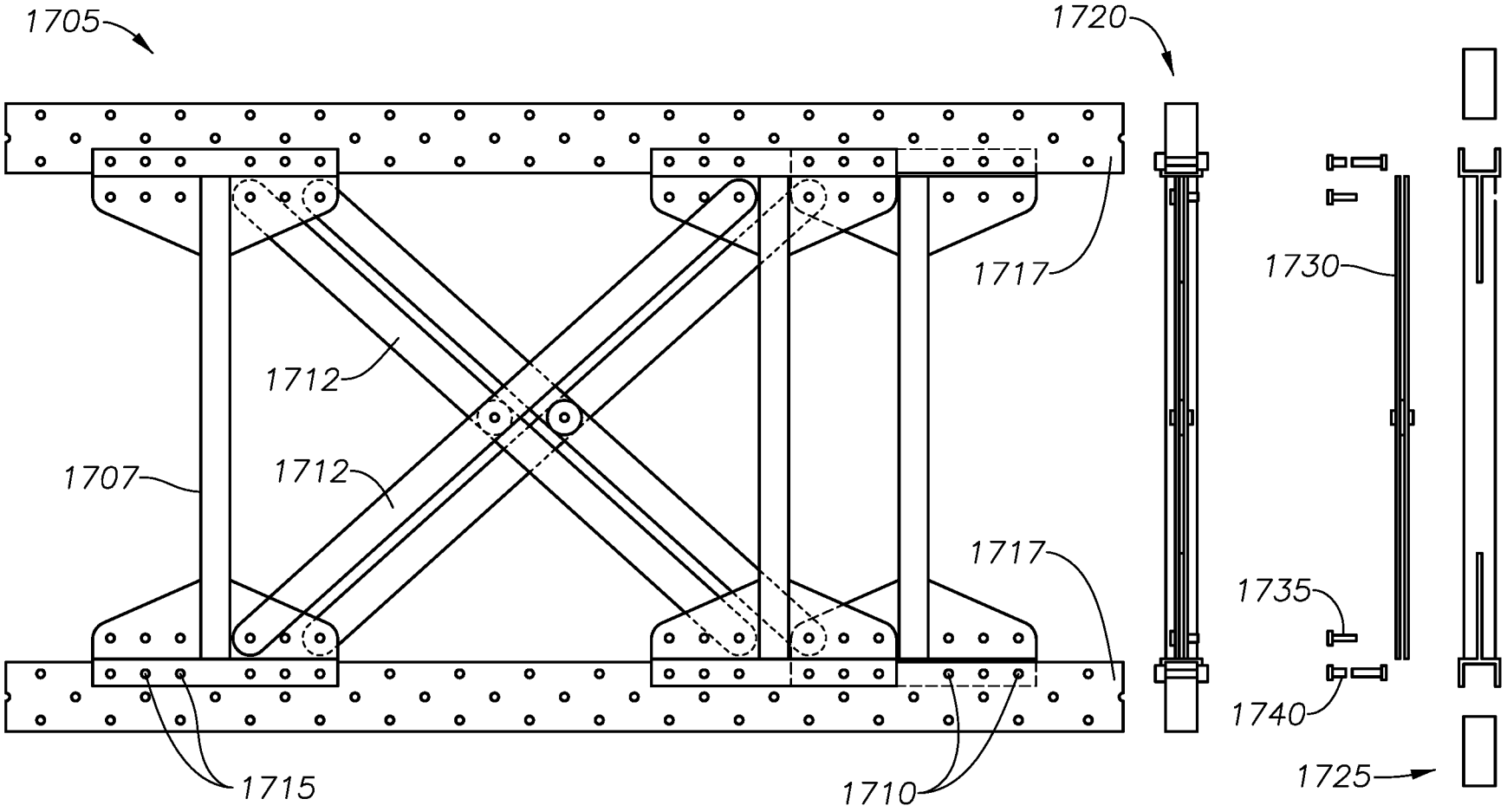
FIG. 17 illustrates a ledger strut and bracing assembly range in accordance with implementations of various techniques described herein.

FIG. 17 shows a ledger strut and bracing assembly range. The ledger strut 1707 and ledger brace members 1712 are longitudinally adjustable along a pair of ledger rails 1717 in a bracing assembly 1705. Hole patterns in the ledger struts 1715 and the ledger rails 1710 allow different spacing. In one implementation, the hole patterns are punched into the rails at the time of manufacture. The ledger struts 1707 and ledger brace members 1712 in this example configuration can be adjusted along the rails using the hole patterns 1710, 1715. In addition, spacing between the bracing can be adjusted using the hole patterns present on the ledger rails 1717 and ledger strut 1707. Also shown in FIG. 17 are a ledger end view 1720, a ledger brace 1730, an exploded ledger end view 1725, a strut connector 1740 and a brace connector 1735.

In one implementation, different spacing between the ledger rails in a bracing assembly can be achieved by using differently sized brace members 1712 with the ledger struts 1707. In one implementation, different spacing can also be achieved by adjusting lateral spacing between two ledger struts that are coupled to a brace member. In this implementation, moving ledger struts closer together or further apart and adjusting a coupling location for the brace members along the hole pattern of the ledger struts allows for different spacing to be achieved between the ledger rails.

Figure 18:
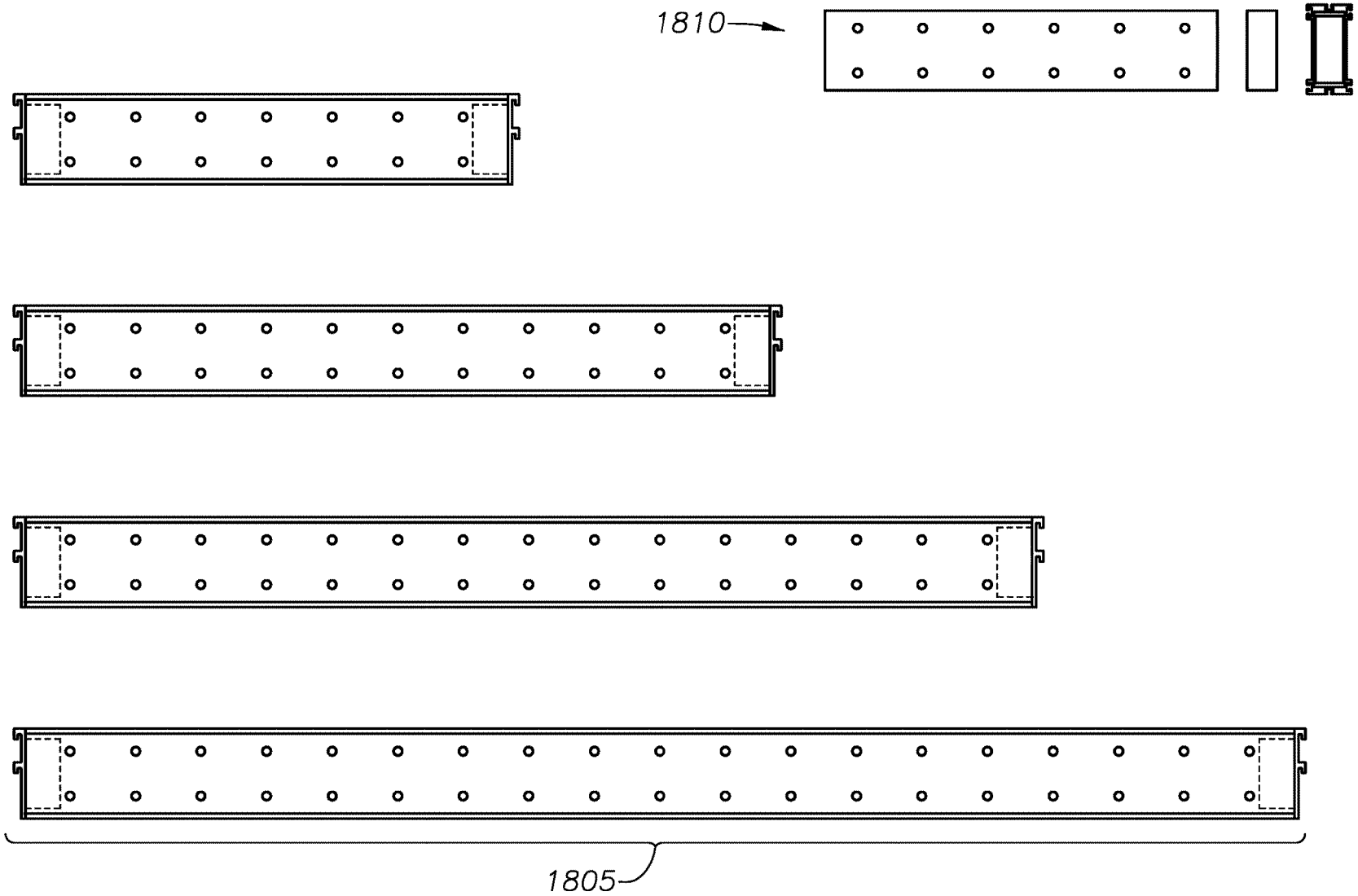
FIG. 18 illustrates examples of modular header beams in accordance with implementations of various techniques described herein.

FIG. 18 shows examples of modular header beams. Header beams 1805 may have lengths of 4 feet, 6 feet, 8 feet, and 10 feet are shown. In addition, a 3 foot header splice 1810 is shown. The modular header beams, which can be used for a drop deck shoring application are extruded out of aluminum and use modular fittings to attach to the drop deck panels. In addition, the modular header beams can be used without the fittings as open beams. When used as an open beam, e.g., a header beam, capacity can be increased and provides the ability to accept a higher load.

In one implementation, standard aluminum form panels used in a drop deck shoring application can be easily stripped from the finished concrete pour while leaving the shoring posts in place as re-shoring for the next elevated pour. Re-shoring is used to support fresh concrete floor slabs from underneath while shoring is placed on top for the next elevated floor slab pour.

Figure 19:
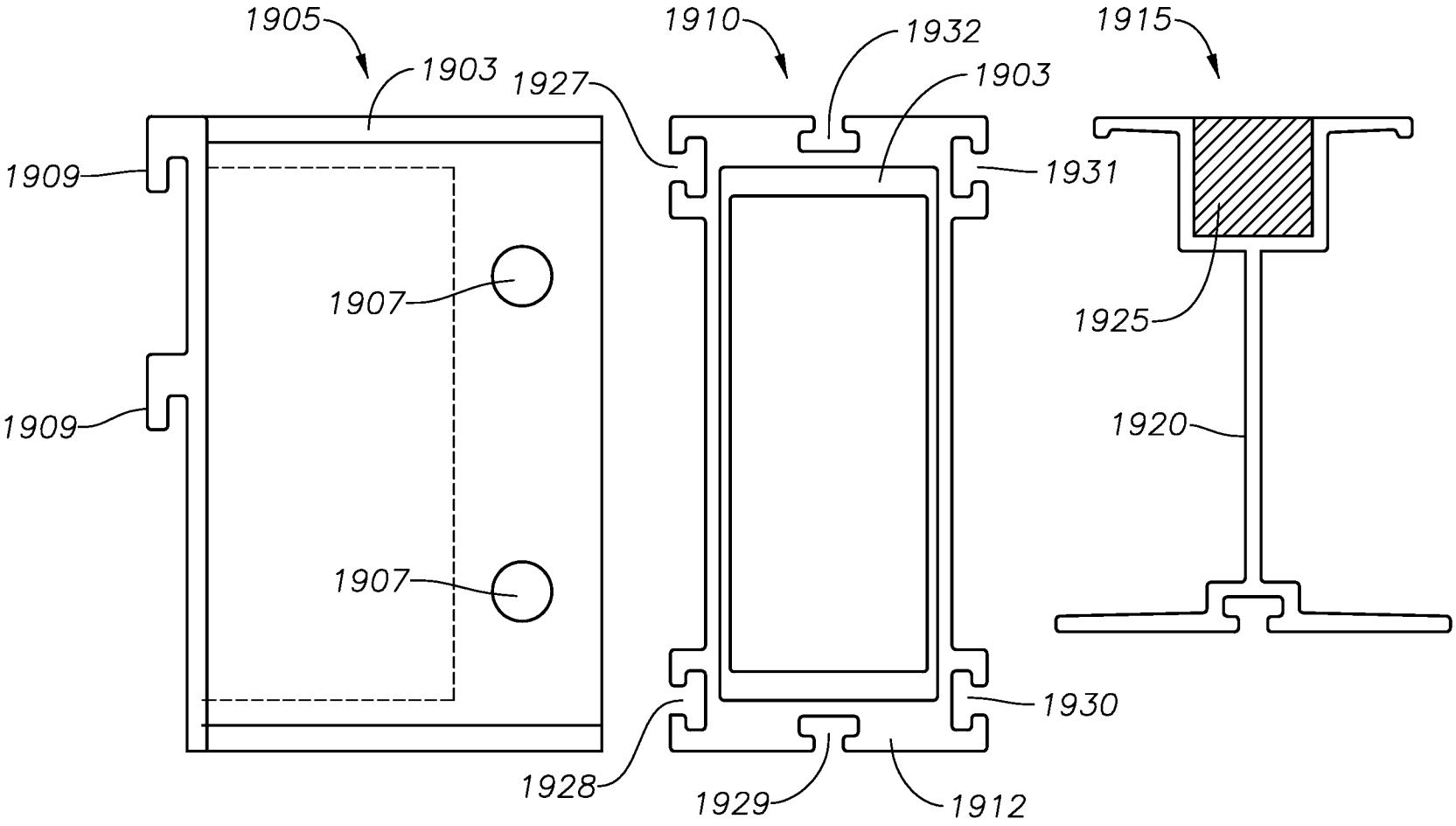
FIG. 19 illustrates beam and joist components in accordance with implementations of various techniques described herein.

FIG. 19 shows beam and joist components. FIG. 19 shows a side cutaway view 1905 of a modular header connector fitting 1903. Modular header connector fitting 1903 includes a plurality of hooks 1909 and a plurality of openings 1907. Modular header connector fitting 1903 is shaped to fit within modular header beam 1912. Modular header connector fitting 1903 may be coupled to the modular header beam 1912 via openings 1907. FIG. 19 also shows a view 1910 of a header extrusion, e.g., header beam 1912, with modular header connect fitting 1903 inserted within the header beam 1912. Header beam 1912 includes various openings 1927, 1928, 1929, 1930, 1931, 1932 used to couple the header beam to other components of the integrated construction system. FIG. 19 further shows a view 1915 of a joist 1920 with a synthetic nailer 1925.

FIG. 19 shows a cross section of the modular header beam 1912. Openings 1927, 1928, 1929, 1930, 1931, 1932 are long grooves when the modular header beam 1912 is extruded as a long member. The grooves are used to couple various metal clips, for example, as described above with respect to FIG. 1. An aluminum joist, e.g., joist 1920, 1935, 1940, 1945, may be coupled to modular header beam 1912 using a metal clip with a nut and bolt. In one implementation, the head of the bolt slides into the groove of the header beam and the clip can be coupled to the joist. In one implementation, a panel clip, e.g., panel clip 2056, may be coupled to the sides of the modular header beam 1912 to hold formwork panels in place when used for shoring a concrete slab.

Figure 20:
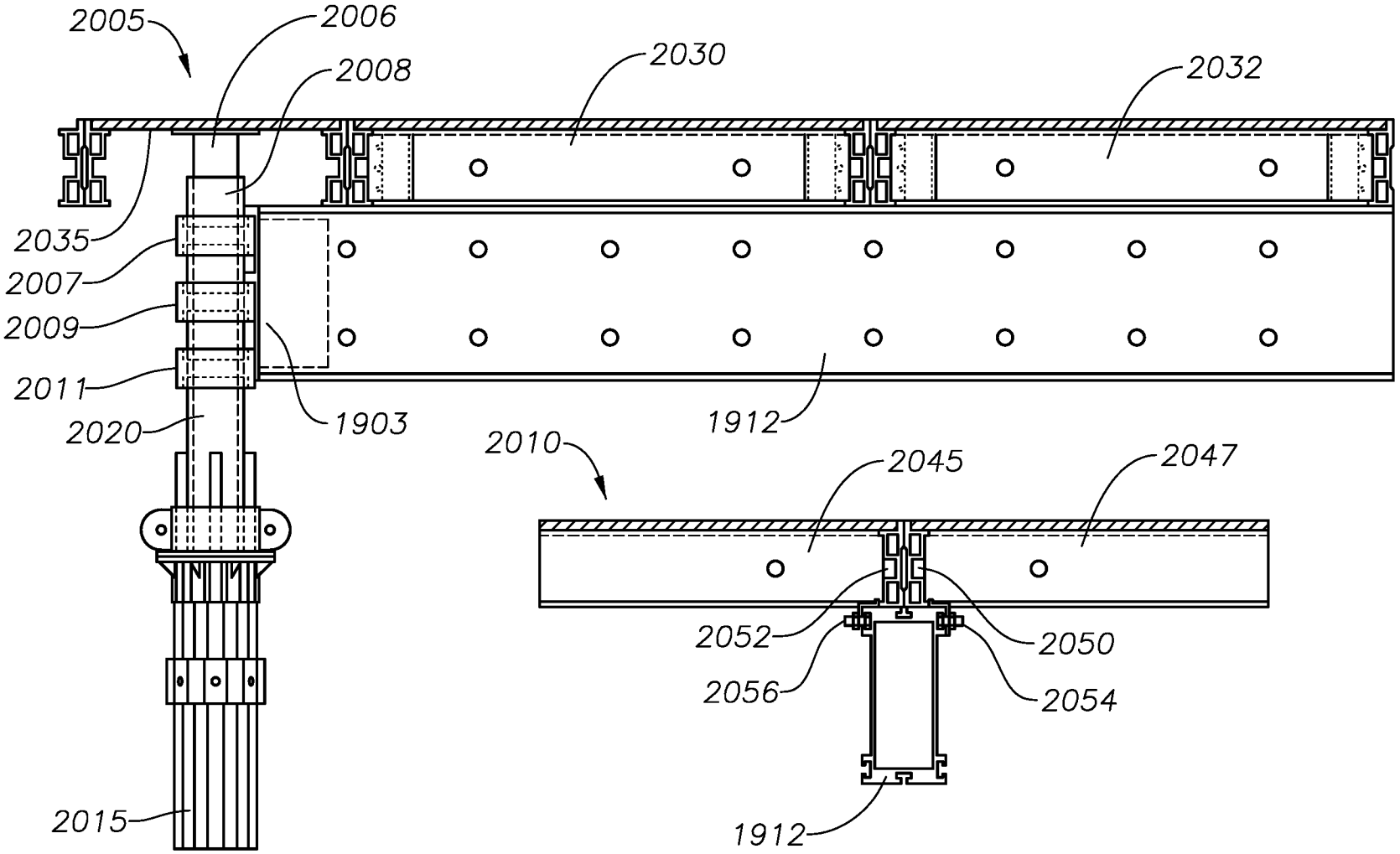
FIG. 20 illustrates modular shoring using standard panel decking in accordance with implementations of various techniques described herein.

FIG. 20 shows modular shoring using standard panel decking. Item 2005 is a side view of a shoring configuration that uses a post 2015, deck drop head assembly 2020, and a modular header beam 2025 to support standard aluminum form panels 2030, and plywood filler 2035 in a shoring application. Deck drop head assembly 2020 includes a plurality of couplings/fittings made into an adjustable assembly, shown in FIG. 11, as an exploded view item 1105 with individual items 1112, 1114, 1116, 1118, 1120 and an assembled view item 1102. This is the same as FIG. 20 with items 2007, 2008, 2009, 2011 and 2020. Couplings/fittings 2007, 2009, 2011 are welded to a sleeve 2008 or 2020. The sleeve 2008 is slide-ably engaged with an inner tube 2006.

An adjusting nut, FIG. 11, item 1120, of the deck drop head assembly 2020 has two settings. The first setting occurs when the deck drop head assembly 2020 is set in place prior to a concrete pour, as shown in FIG. 20. Once the concrete slab is poured and hardens, the nut of the deck drop head assembly 1120 is twisted 90 degrees so that the sleeve 2008 drops downward. The header beam 1912, deck panels 2030, 2032 and filler 2005 drop as well and can be stripped out and set for later use. In this implementation, the post 2015 may remain in place as re-shoring and another set of posts may be installed on the next floor level. The stripped deck panels 2030, 2032 and header beams 1912 can then be installed on the next set of posts so that the next flour slab can be poured. This process may be repeated until all floors have been poured. The plurality of couplings 2007, 2009, 2011 are shaped to accommodate the plurality of hooks 1909 of the modular header connector fitting 1903. The modular header beam 1912 is coupled to the deck drop head assembly 2020 via modular header connector fitting 1903 and supports standard aluminum form panels 2030, 2032. In this implementation, deck drop head assembly 2020 supports plywood filler 2035. The standard aluminum form panels 2030, 2032 are useable for both formwork and shoring applications.

View 2010 is a view in a span direction of the modular header beam 1912 holding up standard aluminum panels 2045, 2047. Form alignment plates 2050, 2052 are used to connect the modular header beam 1912 to the standard panels 2045, 2047. Deck panel clip 2054 is used to couple modular header beam 1912 to standard aluminum panel 2047. Deck panel clip 2056 is used to couple modular header beam 1912 to standard aluminum panel 2045. Deck panel clips 2054, 2056 are used to couple the header beam to other components using grooves 1927, 1928, 1929, 1930, 1931, 1932 as described above with respect to FIG. 19.

Figure 21:
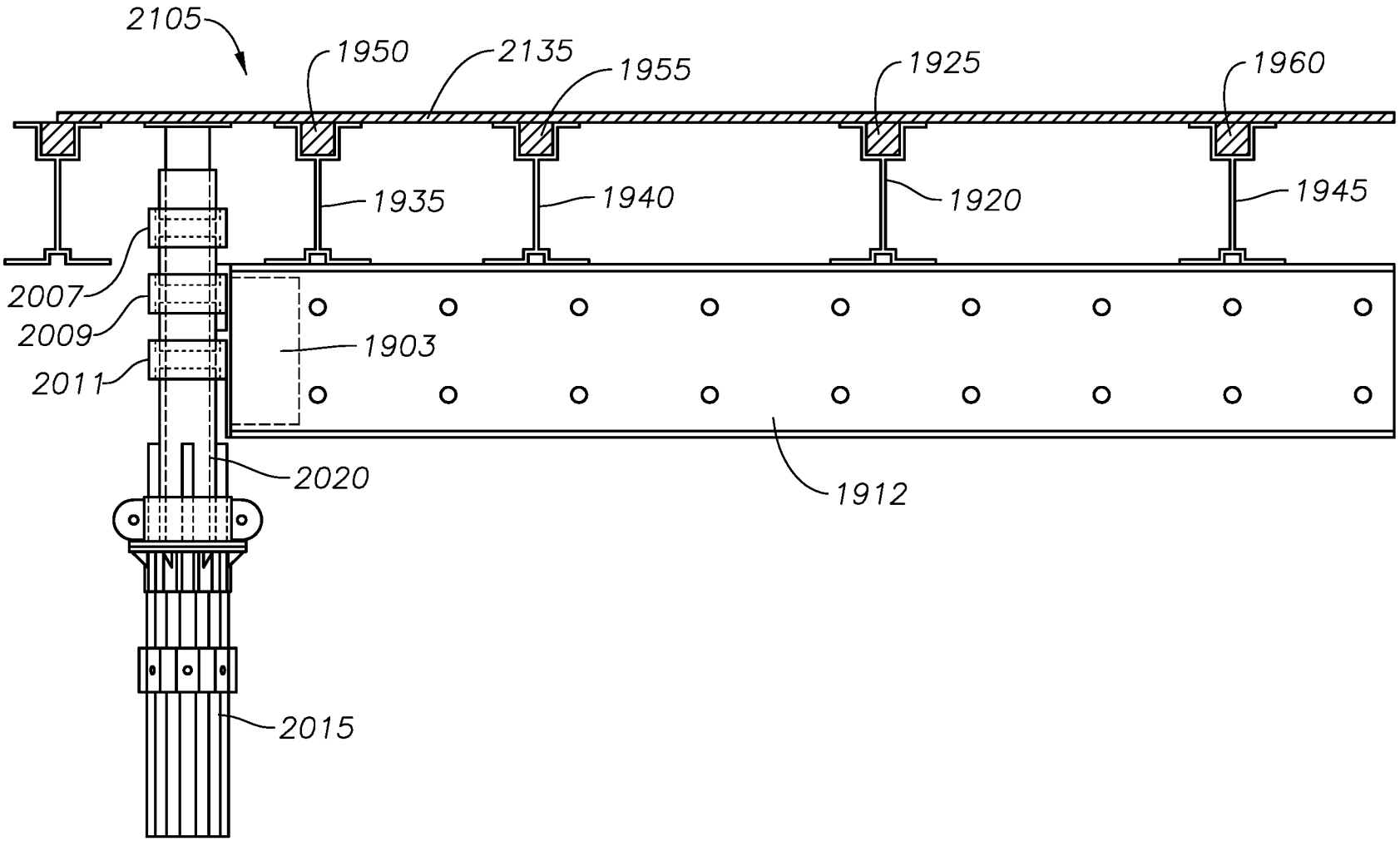
FIG. 21 illustrates modular shoring using standard joist decking in accordance with implementations of various techniques described herein.

FIG. 21 shows modular shoring using standard joist decking. Item 2105 is a side view of a shoring configuration that uses a post 2015, deck drop assembly 2020, and a modular header beam 1912 to support joists 1920, 1935, 1940, 1945 holding up plywood deck material 2135. Deck drop head assembly 2020 includes a plurality of couplings 2007, 2009, 2011. The plurality of couplings 2007, 2009, 2011 are shaped to accommodate the plurality of hooks 1909 of the modular header connector fitting 1903. The modular header beam 1912 is coupled to the deck drop head assembly 2020 via modular header connector fitting 1903 and supports the plywood deck material 2135 using joists 1920, 1935, 1940, 1945 and deck drop head assembly 2020. Joists 1920, 1935, 1940, 1945 may be coupled to the plywood deck material 2135 using synthetic nailers 1925, 1950, 1955, 1960.

The standard panels 2030, 2032 of FIG. 20 are 4" deep. The joists 1920, 1935, 1940, 1945 of FIG. 21 are 6.5" deep. In addition, 0.5" thick plywood sits on top of joists 1920, 1935, 1940, 1945. In this implementation, a joist and plywood configuration has a total depth of 7". The difference between the standard panel configuration of FIG. 20 and the joist/plywood configuration is 3". The three fittings 2007, 2009, 2011 on the drophead attachment 2020 are spaced 3" apart. Because of the difference in depth of the two configurations (FIG. 20 and FIG. 21), header beam 1912 is coupled to the deck drop head assembly 2020 using the top two fittings 2007, 2009 in FIG. 20 and is coupled to the deck drop head assembly 2020 using the bottom two fittings 2009, 2011 in FIG. 21.

As described above with respect to FIG. 18, the modular header beam 1912 is a hollow aluminum extrusion. As shown in FIG. 18, FIG. 19, FIG. 20 and FIG. 21, the modular header beam has a first end and a second end and is configured to interchangeably support shoring panels of a shoring assembly (see FIG. 20) and decking panels of a decking assembly (see FIG. 21).

Figure 22:
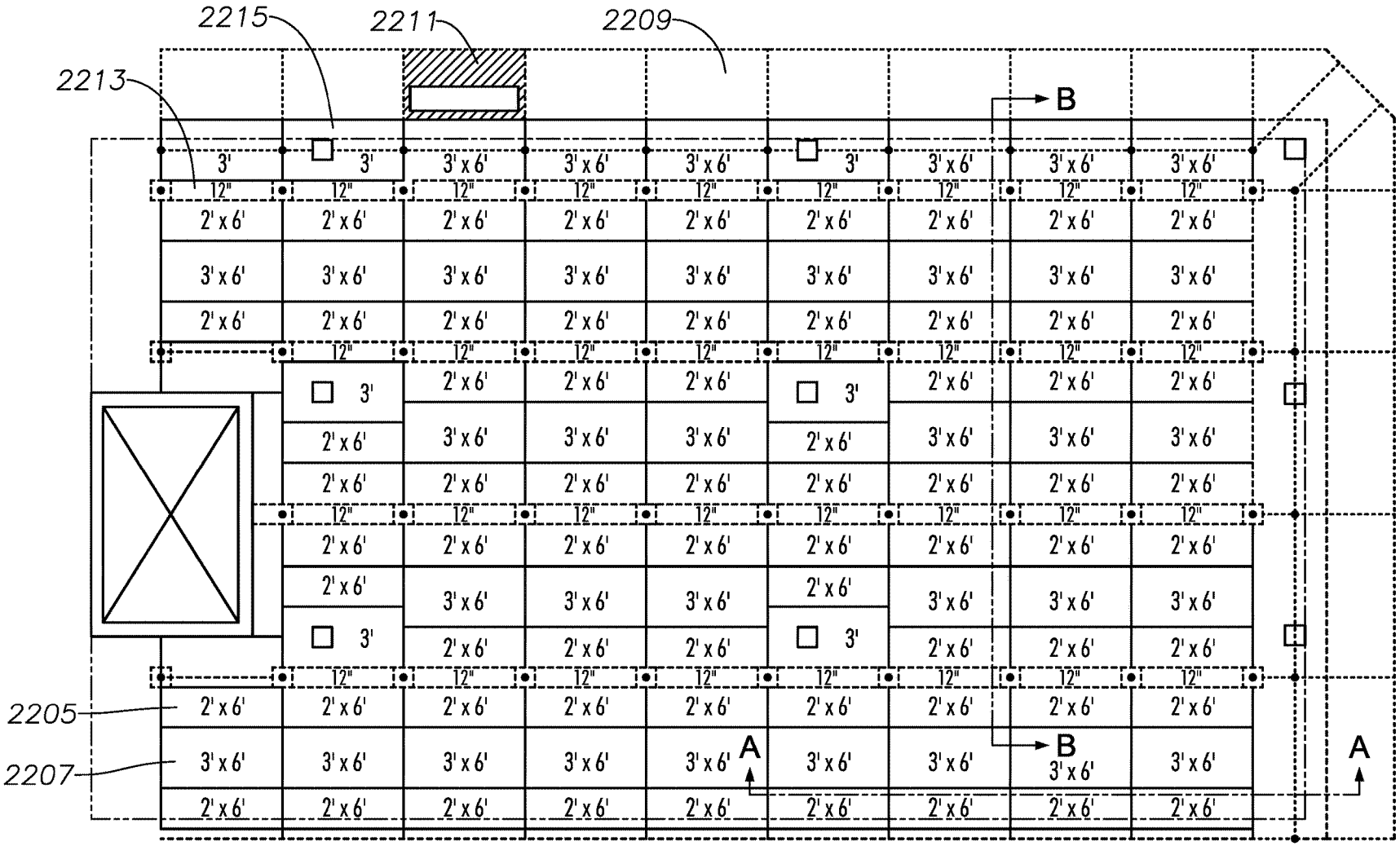
FIG. 22 illustrates a modular shoring plan where standard aluminum panels and filler are used to provide shoring in accordance with implementations of various techniques described herein.

FIG. 22 shows an implementation of a modular shoring plan of an integrated construction system where standard aluminum panels and filler are used to provide shoring. Although any of the standard aluminum panels can be used in a shoring application, this implementation shows 2×6 and 3×6 panels, e.g., panels 2205, 2207, being used to provide shoring for a horizontal concrete slab. In addition, different sized filler panels can be added as needed. FIG. 22 shows 12 inch (panel 2213) and 3 foot (panel 2215) panels. Panels in prior art shoring systems are only designed for deck slabs. Prior art shoring panels were not used for columns, walls, etc. The present integrated construction system uses panels that can be used vertically for formwork and horizontally for shoring applications. FIG. 22 also shows a perimeter safety deck 2209. FIG. 22 additionally shows an access bay 2211 that provides access to a lower level of a structure under construction. The integrated construction system includes components that may be used interchangeably in formwork, shoring and/or worker access configurations. Different views of the standard aluminum panels being supported by components of the integrated construction system are described below with respect to FIG. 23. The views described below are denoted by an A-A view, which provides a view in a first direction relative to the shoring application and a B-B view, which provides a view in a second direction relative to the shoring application.

Figure 23:
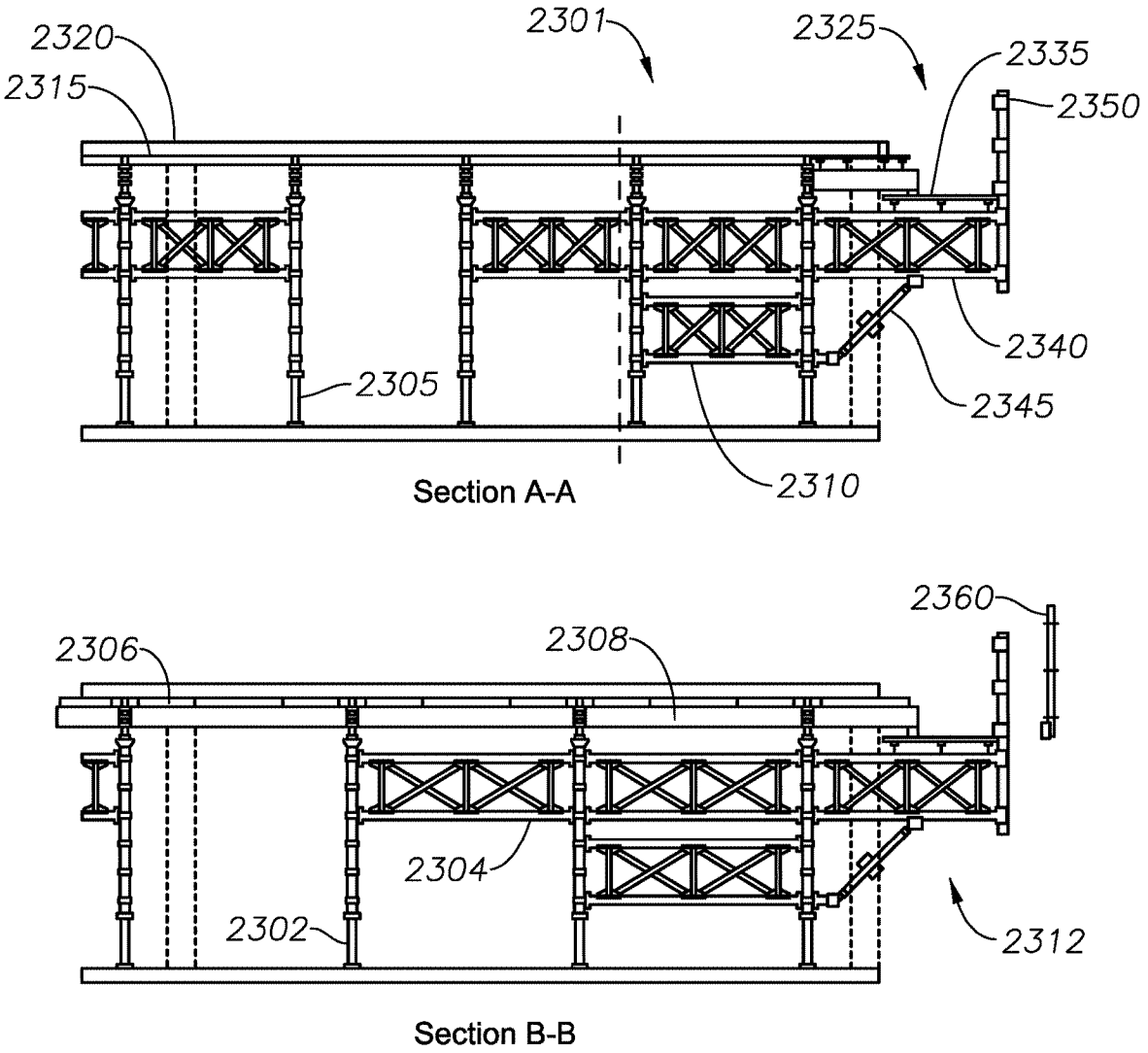
FIG. 23 illustrates modular shoring sections and details in accordance with implementations of various techniques described herein.
Figure 23:
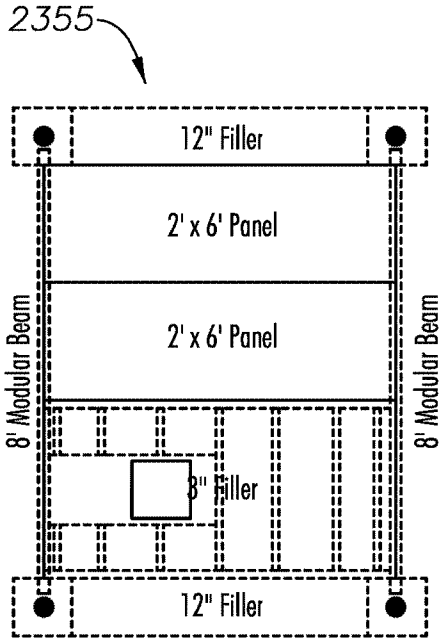

FIG. 23 shows an implementation of modular shoring sections and details. Section A-A is a side view of the shoring support structure. A portion 2301 of Section A-A corresponds to the elements present in FIG. 1. In this view, various posts 2305 and bracing assemblies 2310 are used to support standard aluminum panels 2315 holding up a poured concrete slab 2320. In addition, a perimeter safety deck 2325 is formed from a bracing assembly 2340, joists 2335, a ledger rail 2350 and a bracing element 2345. Section B-B is a view from a different side showing the posts 2302, bracing assemblies 2304, standard aluminum panels 2306, header beams 2308, and the perimeter safety deck 2312. In one implementation, the perimeter safety deck uses an optional pinlock guardrail 2360. FIG. 23 further shows, in greater detail, a view 2355 of a column area of the example shoring deck. This implementation illustrates how to use standard aluminum form panels for both vertical and horizontal applications. In addition, this implementation may be used in a drop deck shoring application.

Figure 24:
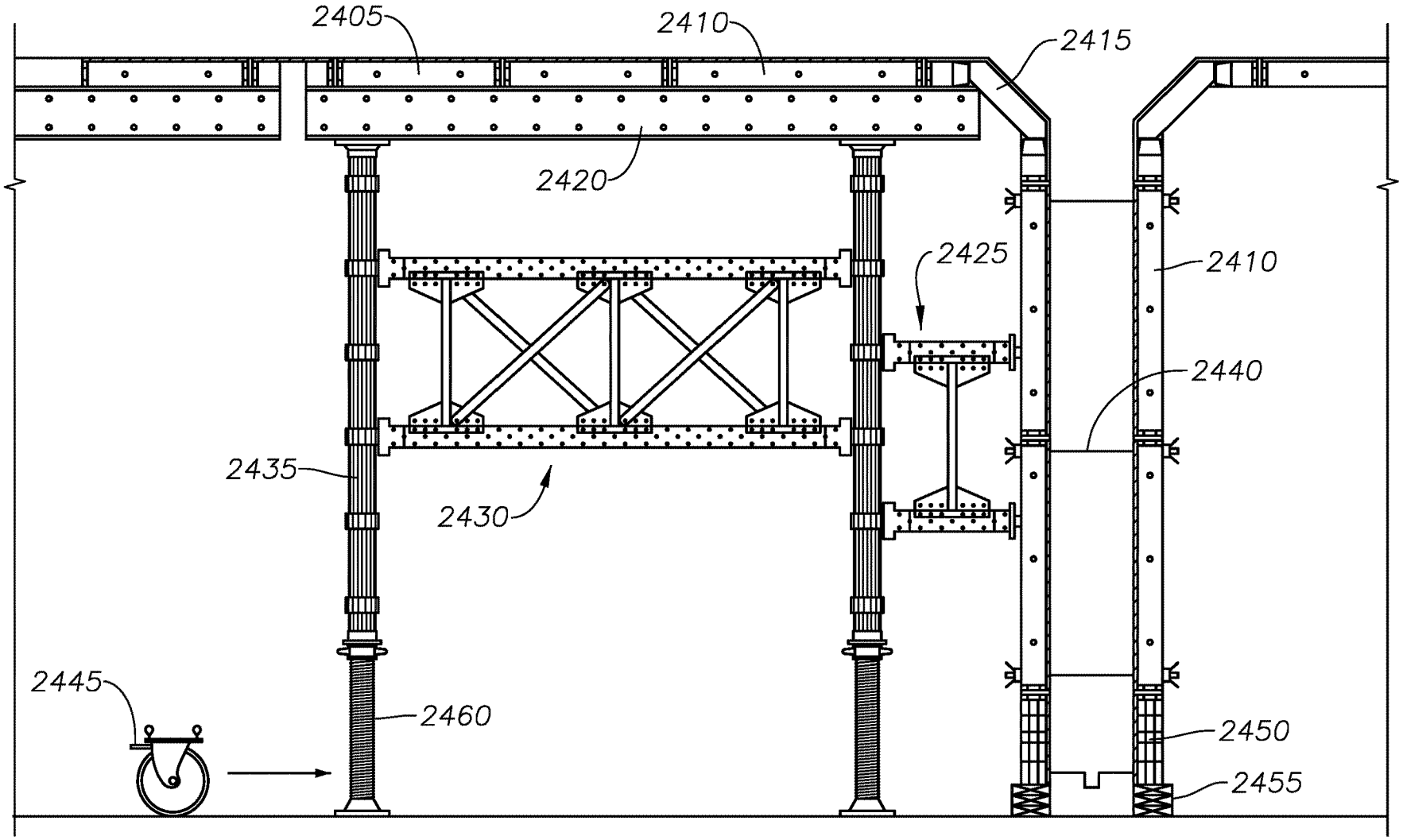
FIG. 24 illustrates various components of the integrated construction system being used together to form a tunnel form in accordance with implementations of various techniques described herein.

FIG. 24 shows various components of the integrated construction system being used together to form a tunnel form. In this implementation, the aluminum form panels are used in a hybrid application where both a formwork and a shoring configuration are used to create the tunnel form. This configuration includes formwork panels 2405, 2410, culvert form 2415, modular header beam 2420, bracing assemblies 2425, 2530, posts 2435 coupled to screw leg assemblies 2460, tie assemblies 2440, standard adjustable filler 2450, and wood shim 2455. In some implementations, swivel caster shoe 2445 may be coupled to posts 2435 via screw leg assembly 2460. Tunnel form applications can be used to provide an underground culvert, e.g., under a road, that water flows through.

Culvert form 2415 is made using components of a standard adjustable filler, e.g., filler side rails, lumber clips, and custom-cut wood inner rails to make the shape of a 45 degree corner. Wood shim 2455 may optionally be used by a contractor to achieve a correct form height The configuration of FIG. 24 utilizes both formwork and shoring components to achieve a particular configuration. Using formwork and shoring components of the present system minimizes the amount of components needed from disparate systems and also minimizes the amount of custom items that would need to be crafted to achieve a configuration similar to the configuration shown in FIG. 24.

Figure 25:
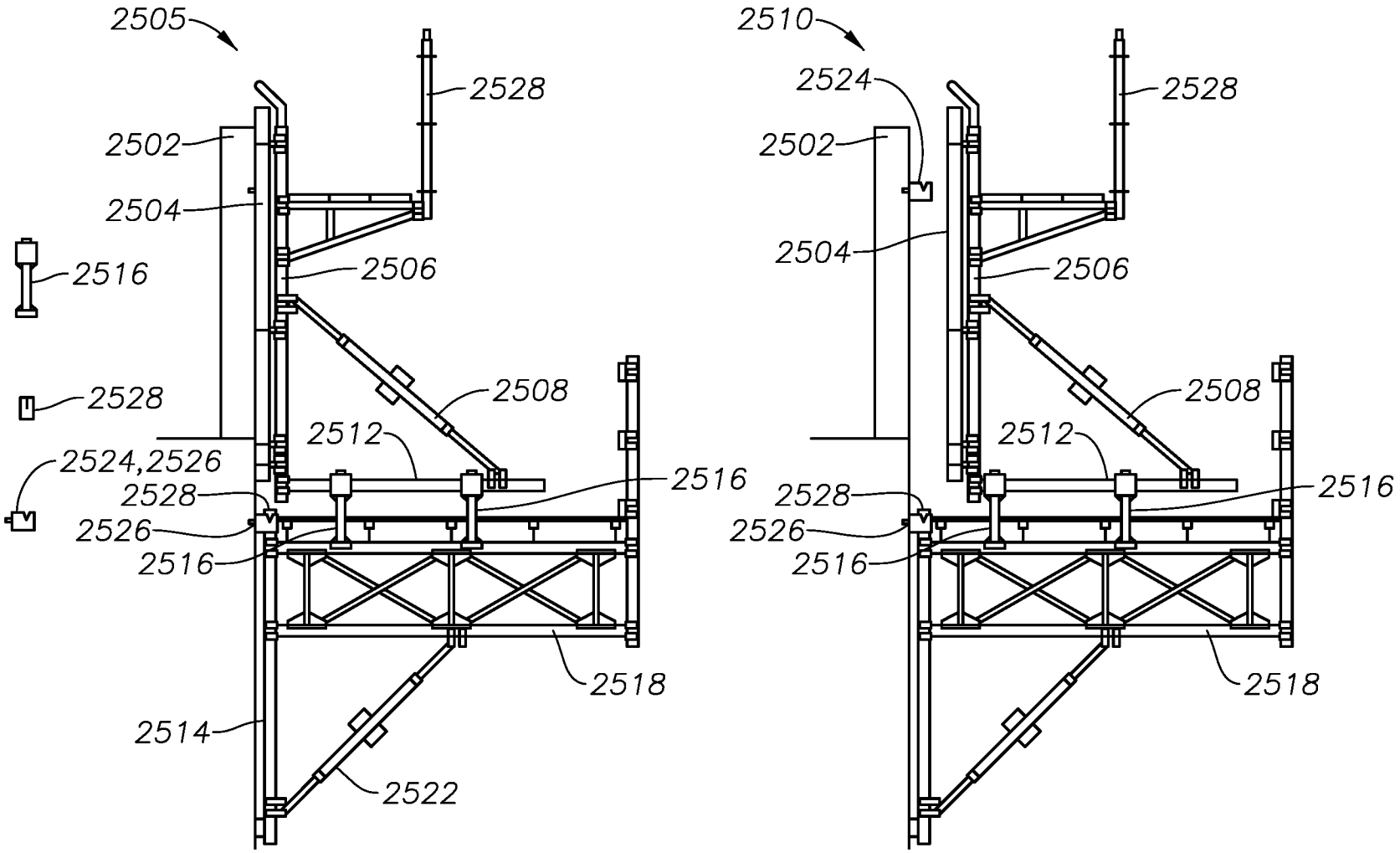
FIG. 25 illustrates a rollback shearwall deck in accordance with implementations of various techniques described herein.

FIG. 25 shows two views that show a rollback shearwall deck. In view 2505, the rollback mechanism is shown in a set position, i.e., adjacent to the concrete wall 2502. The rollback mechanism includes one or more standard panels 2504, at least one first vertical ledger rail 2506 coupled to at least one horizontal ledger rail 2512 and supported by brace 2508. The one or more horizontal ledger rails are coupled to a bracing assembly 2518 by a rollback strut 2516. The bracing assembly 2518 is coupled to at least one second vertical ledger rail 2514 and supported by brace 2522. In view 2510, the rollback mechanism is shown in a fly position, i.e., pulled back from the concrete wall. In the fly position, elements 2504, 2506, 2508, 2512, 2516 are moved laterally along bracing assembly 2518 from the set position to the fly position. The implementation shown in FIG. 25 provides a rollback shear wall deck system and worker access platform application. Ledger panels are used to provide this rollback mechanism in both vertical and horizontal configurations. FIG. 25 also shows landing bracket 2524, 2526 and landing bracket 2528.

Once the concrete wall 2502 is poured at one level (in view 2505), the rollback shearwall deck is rolled back to a stripped position (in view 2510). A second landing bracket 2524 is anchored to the new wall (concrete wall 2502), then the entire rollback shearwall deck (i.e., the wall form that includes panel 2504 and the work platform that includes bracing assembly 2518) is lifted vertically from the top to the second landing bracket 2524. Landing bracket 2528 is mounted to an inside edge of the work platform and rests in a groove of landing bracket 2526. When the entire rollback shearwall deck is lifted, landing bracket 2528 comes off the lower landing bracket 2526, and is placed on the second landing bracket 2524, and the process repeats itself until the building is completed to the roof.

The arrangement shown in views 2505, 2510 is called a "Roll-Back Jump-Form" because the form jumps from one elevation to the next as vertical construction progresses. The present system utilizes standard components, with a few additional items, e.g., various fillers or other items, to satisfy particular formwork and shoring applications. Prior art systems have more specialized systems and do not use standard components that can be used in various configurations to address various needs.

FIG. 25 illustrates another example of using an integrated construction system to provide both formwork and shoring to form an exterior shearwall, for example, those typically found on high rise buildings. The wall form and platform are assembled as a unit to allow worker access outside of the building limits at elevation The wall form and work platform can be picked up with a crane as a unit and landed onto a bracket at the next elevation. The wall form and work platform also allow the crane rigging to be released safely by the construction workers. The crane rigging is released more safely because the form panel seats itself onto the bracket securely and uses gravity to hold it in-place without human interaction. This allows the workers to access the platform safely to remove the rigging and complete the next wall pour.

Figure 26:
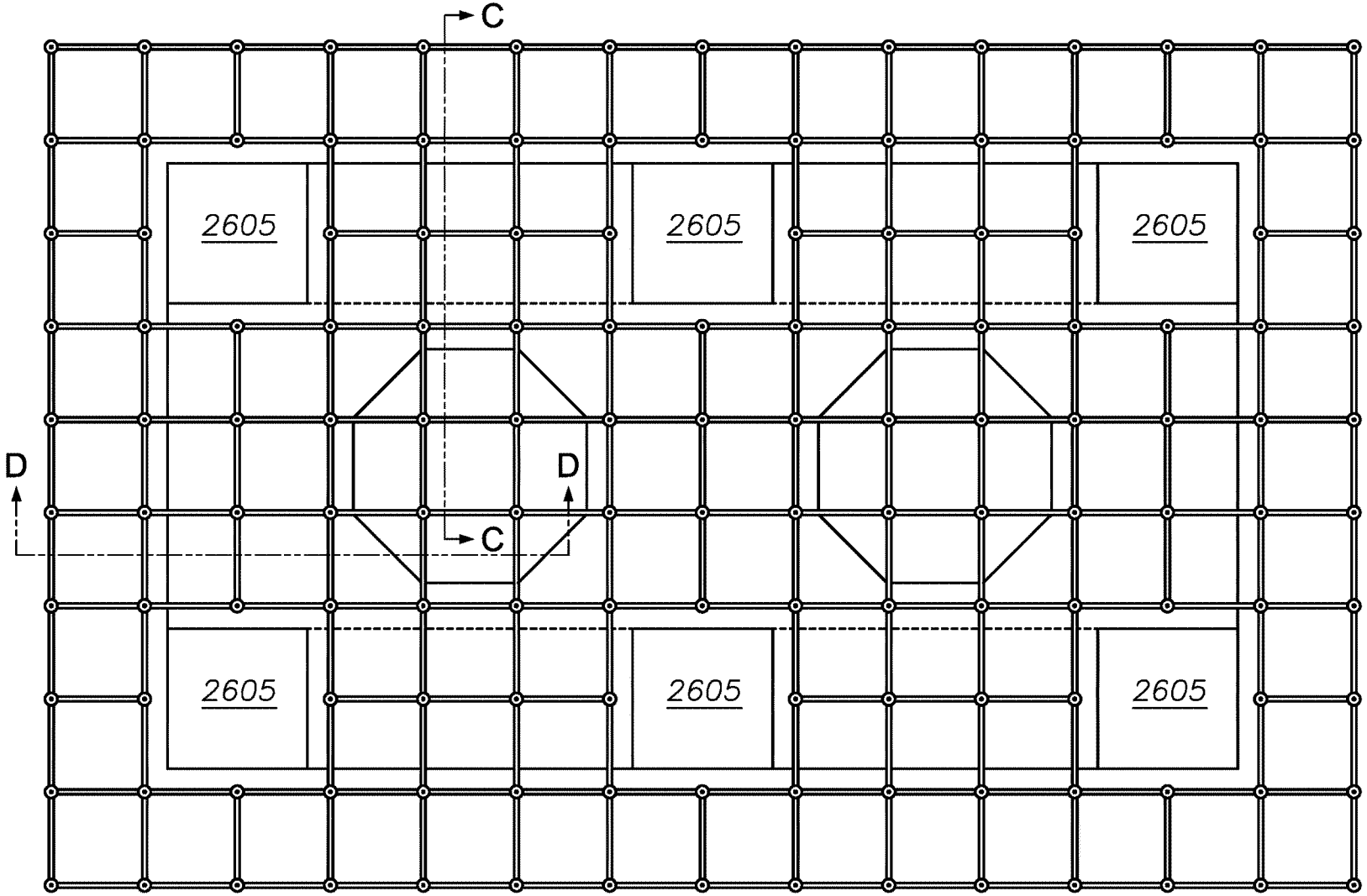
FIG. 26 illustrates a plan view of the HD shoring application in accordance with implementations of various techniques described herein.
Figure 27:
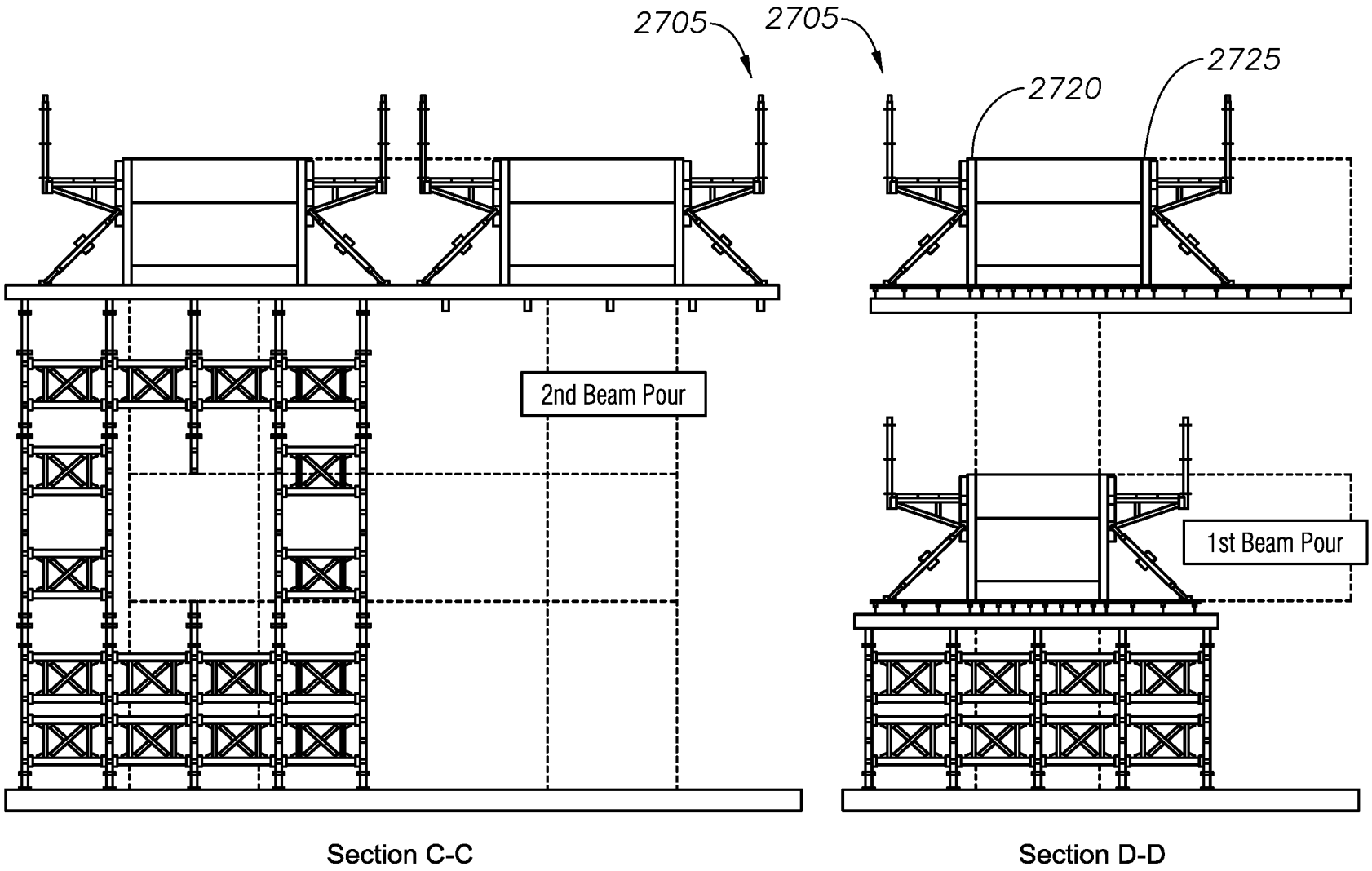
FIG. 27 illustrates an elevational view of the HD shoring application in accordance with implementations of various techniques described herein.

FIG. 26 and FIG. 27 show an industrial heavy duty (HD) shoring application. In particular FIG. 26 shows a plan view of the HD shoring application and FIG. 27 shows an elevational view of the HD shoring application. The configuration described in FIGS. 26 and 27 is used to create vertical columns and horizontal beams. In particular, FIG. 26 illustrates columns 2605 upon which a next layer of horizontal beams are to be placed. Views C-C and D-D show formwork and shoring for a 2nd beam and a 1st beam, respectively. Also shown in FIG. 27 are worker access platforms 2705 and standard panels 2720, 2725 in a formwork configuration.

Figure 28:
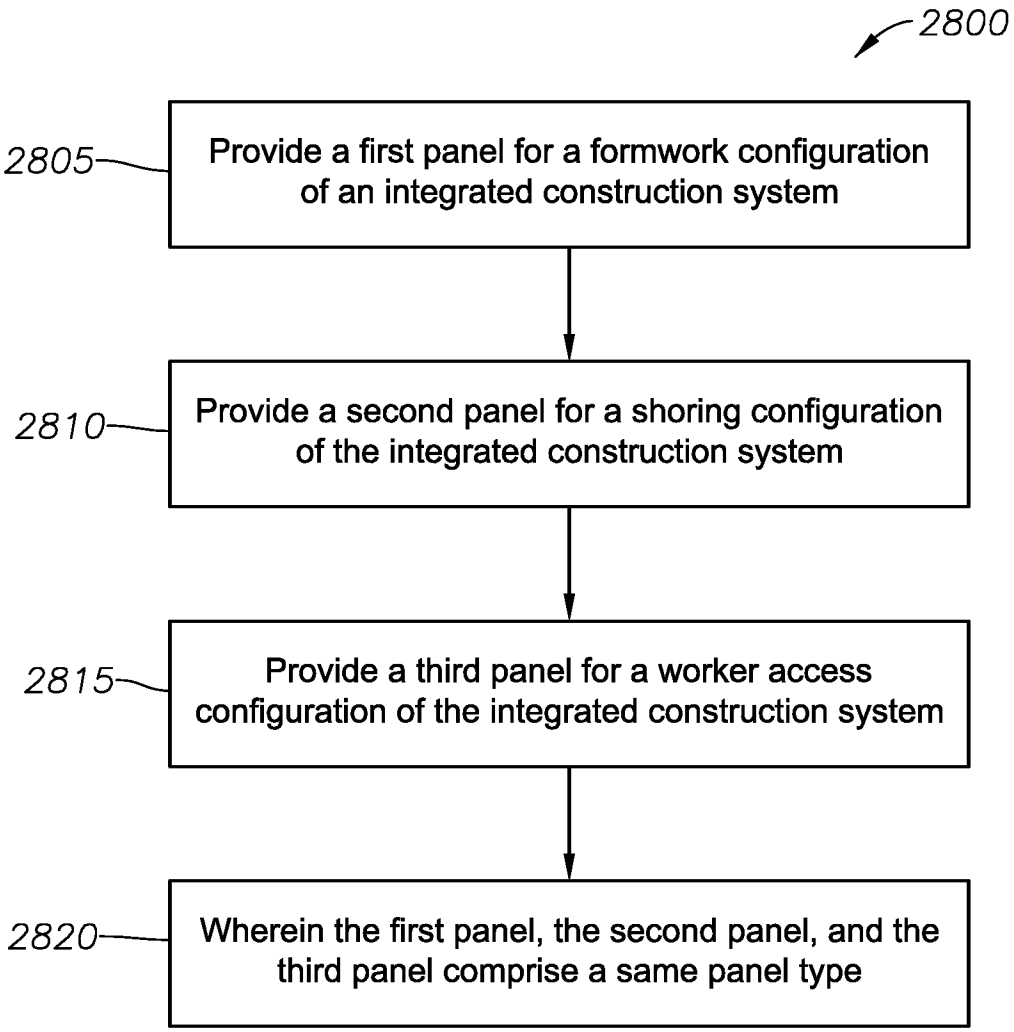
FIG. 28 illustrates a block diagram of a method of providing an integrated construction system in accordance with implementations of various techniques described herein.

FIG. 28 illustrates a block diagram of a method 2800 of providing an integrated construction system. At block 2805, a first panel for a formwork configuration of an integrated construction system is provided. At block 2810, a second panel for a shoring configuration of the integrated construction system is provided. At block 2815, a third panel for a worker access configuration of the integrated construction system is provided. The first panel, the second panel, and the third panel are a same panel type, e.g., modular ledger or standard aluminum panel (form panel).

In one implementation, the posts are all aluminum. The fittings may be cast steel or cast aluminum. With respect to the bracing assembly, the ledger panels are made of aluminum. The end fittings with the screw mechanism may be steel. The vertical struts may be steel. The cross brace may be an aluminum strap. In this manner, the bracing assembly can be a combination of aluminum and steel. The present shoring system does not use any welded aluminum.

The present shoring system includes a number of advantages and benefits. The present shoring system is part of a larger integrated construction system that provides a total solution for formwork, shoring and heavy-duty access. This new larger integrated construction system has significantly less items in its usable inventory, as compared to other independent task focused systems, i.e., prior art independent formwork systems, prior art independent shoring systems, and prior art independent heavy-duty access systems. The present integrated construction system has a unique approach to the type of materials used in its construction, as well as the method of manufacture. The present integrated construction system, by design, minimizes the number of separate components needed to provide shoring, formwork and worker access application. The integrated construction system further provides a unique method of manufacturing the integrated construction system components.

Figure 31:
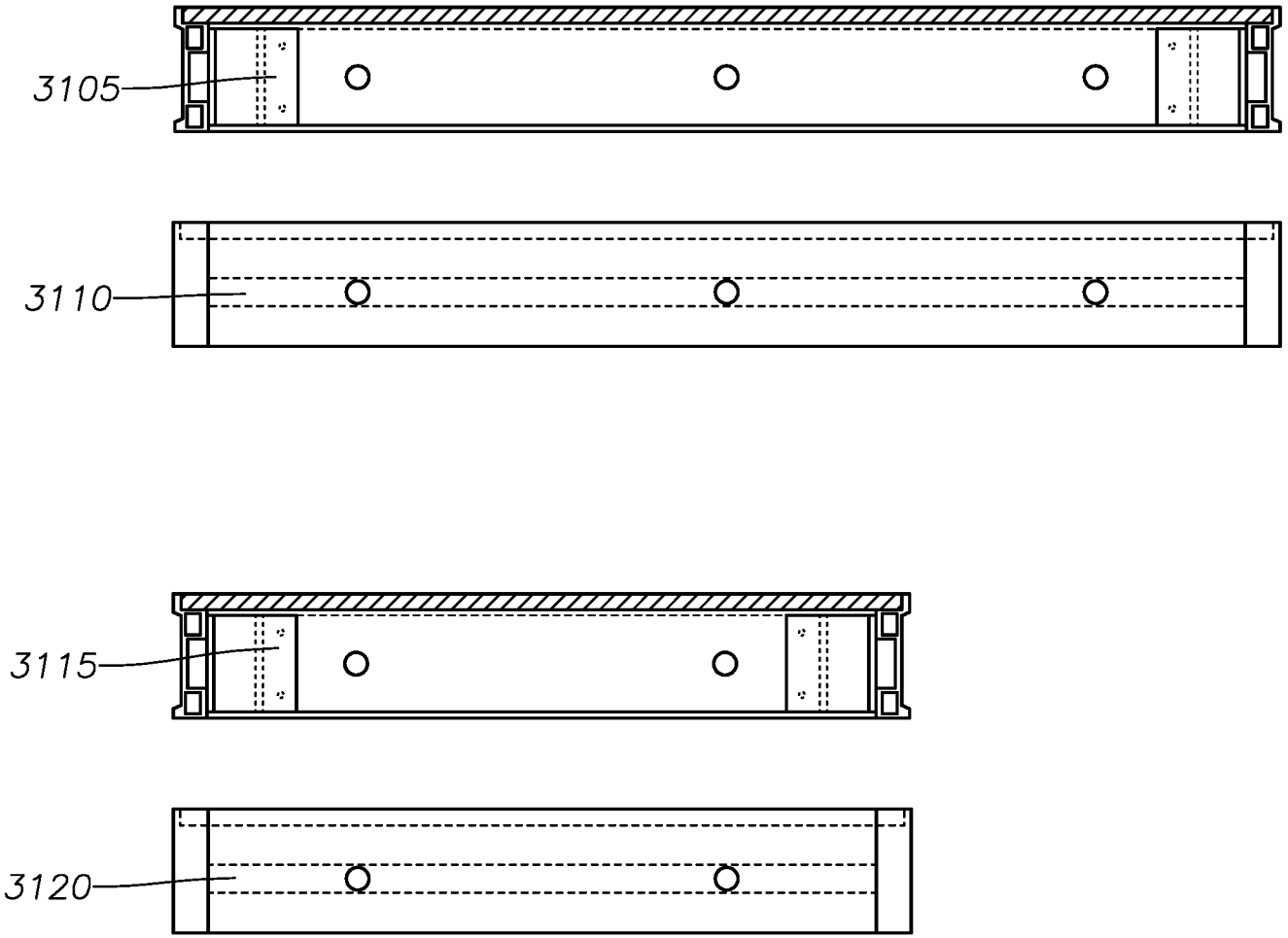
FIG. 31 illustrates standard panel assembly plan views in accordance with implementations of various techniques described herein.
Figure 32:
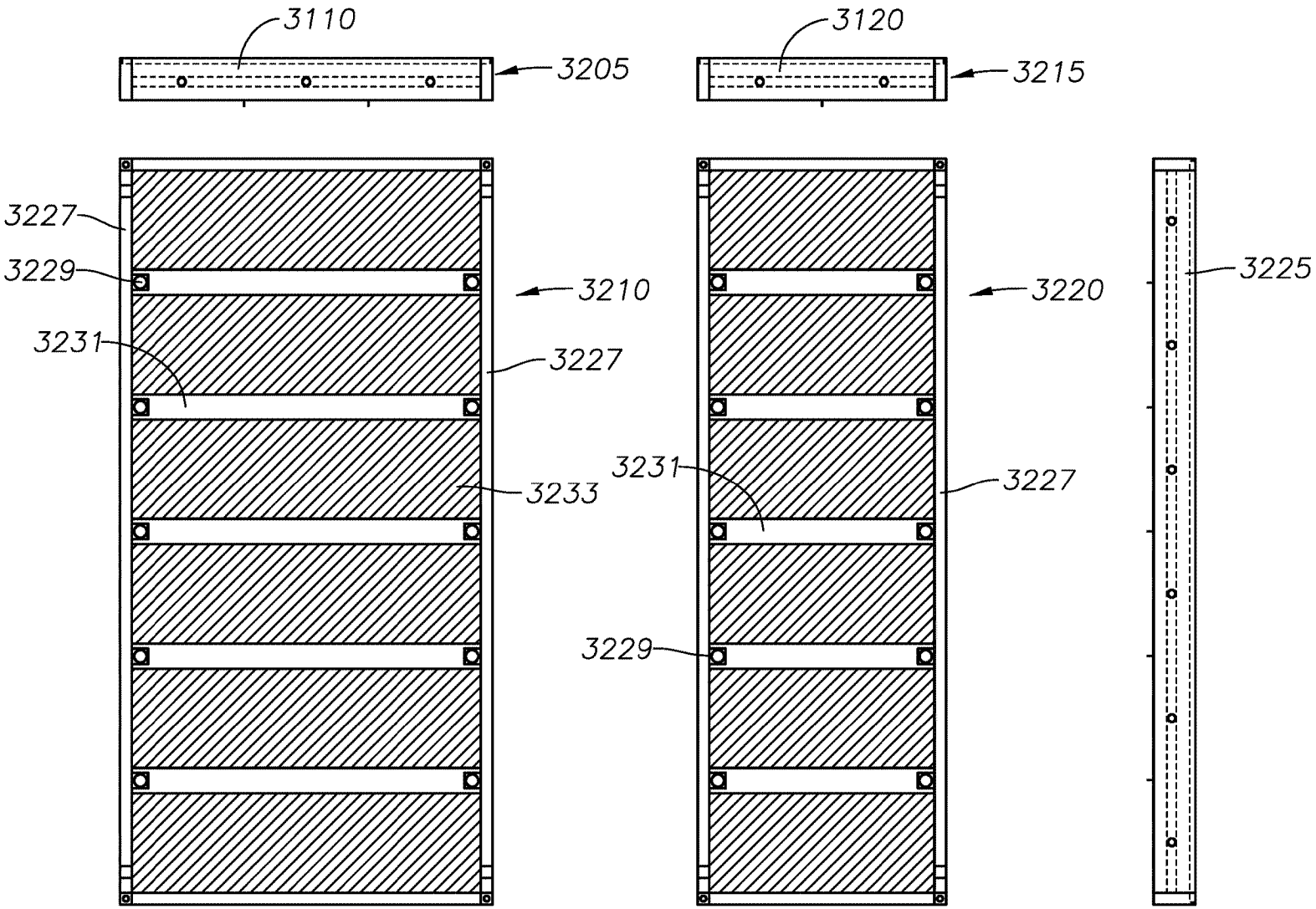
FIG. 32 illustrates elevational views of the standard panel assembly in accordance with implementations of various techniques described herein.

The present integrated construction system uses standard panels, e.g., panels 125, 2030, 2032, 2045, 2047, 2205, 2207, 2315, 2306, 2405, 2410, 2504, 2720, 2725, in various formwork, e.g., vertical formwork, and shoring configurations. FIG. 31 illustrates standard panel assembly plan views. Top/bottom 3110, 3120 and cutaway views 3105, 3115 are shown for both 3 ft (panel 3110) and 2 ft panel (panel 3120) widths. FIG. 32 illustrates elevational views 3210, 3220 of the standard panel assembly for 2' (panel 3120) and 3' (panel 3110) widths. Top/bottom 3205, 3215 and side elevational 3225 views of panels 3110, 3120 are also shown. Each standard panel 3110, 3120 includes side rails 3227, inner rails 3231 and tie extrusions 3229. Standard panels can be 2' or 3' in width. Each standard panel of width 2' or 3' can have a panel length of 3', 6', or 9'.

The integration of formwork, shoring and heavy-duty access into one system creates a unique and singular approach for providing a "construction system" vs. individual systems that are designed to handle one of the three applications. The present integrated construction system reduces the amount of inventoried components by over 75%, as compared to existing systems. In addition, this unique combination of components provides new innovative methods to construction worker access that is currently not available on elevated construction sites.

In combination with the robust nature of the materials of the integrated construction system and the method of assembly, the cost to own the present integrated construction system is vastly reduced for both a dead asset basis, as well as the physical maintenance cost required to maintain a formwork and access inventory. In addition, the integrated construction system provides an increased flexibility to handle field applications, as well as increase the efficiency for the contractors that will use the integrated construction system to build concrete structures.

The discussion above is directed to certain specific implementations. It is to be understood that the discussion above is only for the purpose of enabling a person with ordinary skill in the art to make and use any subject matter defined now or later by the patent "claims" found in any issued patent herein.

It is specifically intended that the claimed invention not be limited to the implementations and illustrations contained herein, but include modified forms of those implementations including portions of the implementations and combinations of elements of different implementations as come within the scope of the following claims. It should be appreciated that in the development of any such actual implementation, as in any engineering or design project, numerous implementation-specific decisions may be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Nothing in this application is considered critical or essential to the claimed invention unless explicitly indicated as being "critical" or "essential."

In the above detailed description, numerous specific details were set forth in order to provide a thorough understanding of the present disclosure. However, it will be apparent to one of ordinary skill in the art that the present disclosure may be practiced without these specific details. In other instances, well-known methods, procedures, components, circuits and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the invention. The first object or step, and the second object or step, are both objects or steps, respectively, but they are not to be considered the same object or step.

The terminology used in the description of the present disclosure herein is for the purpose of describing particular implementations only and is not intended to be limiting of the present disclosure. As used in the description of the present disclosure and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context. As used herein, the terms "up" and "down"; "upper" and "lower"; "upwardly" and downwardly"; "below" and "above"; and other similar terms indicating relative positions above or below a given point or element may be used in connection with some implementations of various technologies described herein.

While the foregoing is directed to implementations of various techniques described herein, other and further implementations may be devised without departing from the basic scope thereof, which may be determined by the claims that follow. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A fitting ring of an integrated construction system, comprising:

an inner portion of the fitting ring configured to be coupled to a post and having protrusions configured to be inserted into a transverse groove on the post, the transverse groove having a longitudinal axis that is perpendicular to a longitudinal axis of the post when the ring is coupled to the post; and an outer portion of the fitting ring configured to be coupled to a ledger rail and configured to enable the fitting ring to support a load transferred to the fitting ring through the ledger rail, wherein the load is configured to be transferred from the fitting ring to ribs on the post via the protrusions and interference of the protrusions with the ribs, wherein the fitting ring is configured to be rotationally locked in position about the longitudinal axis of the post, and wherein all of the protrusions on the inner portion are entirely shaped the same as all of a remainder of protrusions in the inner portion of the fitting ring and wherein the protrusions are intermittently spaced around the inner portion, wherein the fitting ring is configured to be fastened to the post and wherein the fitting ring is configured to be rotationally locked in position about the longitudinal axis of the post when the protrusions are between the ribs and wherein the fitting ring is configured to be rotationally unlocked when the protrusions are in the transverse groove.

2. The fitting ring of an integrated construction system of claim 1, wherein the fitting ring is configured to be mechanically fastened to the post.

3. The fitting ring of an integrated construction system of claim 2, wherein the fitting ring is configured to be fastened to the post using a screw.

4. The fitting ring of an integrated construction system of claim 1, wherein the fitting ring is configured to be slidable about the longitudinal axis of the post.

5. The fitting ring of an integrated construction system of claim 4, wherein the ribs are configured to rotationally lock the fitting ring in place about the longitudinal axis of the post.

6. The fitting ring of an integrated construction system of claim 5, wherein the protrusions on the fitting ring are configured to engage the ribs on the post.

7. A fitting ring and post assembly of an integrated construction system, comprising:

a fitting ring;

a post having at least one transversely oriented groove;

an inner portion of the fitting ring having protrusions, the at least one transversely oriented groove having a longitudinal axis that is perpendicular to a longitudinal axis of the post; and an outer portion of the fitting ring configured to be coupled to a ledger rail and configured to enable the fitting ring to support a load transferred to the fitting ring through the ledger rail;

wherein the fitting ring is rotationally locked in position about the longitudinal axis of the post, wherein the load is transferred from the fitting ring to a rib on the post via the protrusions and interference of the protrusions with the rib, and wherein all of the protrusions on the inner portion are entirely shaped the same as all of a remainder of protrusions in the inner portion of the fitting ring and wherein the protrusions are intermittently spaced around the inner portion, wherein the fitting ring is fastened to the post and wherein the fitting ring is configured to be rotationally locked in position about the longitudinal axis of the post when the protrusions are between the ribs and wherein the fitting ring is configured to be rotationally unlocked when the protrusions are in the at least one transversely oriented groove.

8. The fitting ring and post assembly of an integrated construction system of claim 7, wherein the fitting ring is mechanically fastened to the post.

9. The fitting ring and post assembly of an integrated construction system of claim 7, wherein the fitting ring is fastened to the post using a screw.

10. The fitting ring and post assembly of an integrated construction system of claim 7, wherein the fitting ring is slidable about the longitudinal axis of the post.

11. The fitting ring and post assembly of an integrated construction system of claim 10, wherein the ribs are configured to rotationally lock the fitting ring in place about the longitudinal axis of the post.

12. The fitting ring and post assembly of an integrated construction system of claim 11, wherein the protrusion engages an outer rib portion of the post.

13. A method of making a fitting ring and post assembly of an integrated construction system, comprising:

connecting protrusions of an inner portion of the fitting ring to at least one transversely oriented groove of a post, the at least one transversely oriented groove having a longitudinal axis that is perpendicular to a longitudinal axis of the post; and connecting an outer portion of the fitting ring to a ledger rail and rotationally locking the fitting ring in position about the longitudinal axis of the post;

wherein the fitting ring supports a load transferred to the fitting ring through the ledger rail;

wherein the load is transferred from the fitting ring to a rib on the post via the protrusions and interference of the protrusions with the rib, and wherein all of the protrusions on the inner portion are entirely shaped the same as all of a remainder of protrusions in the inner portion of the fitting ring and wherein the protrusions are intermittently spaced around the inner portion mechanically fastening the fitting ring to the post, wherein the fitting ring is configured to be rotationally locked in position about the longitudinal axis of the post when the protrusions are between the ribs and wherein the fitting ring is configured to be rotationally unlocked when the protrusions are in the at least one transversely oriented groove.

14. The method of claim 13, further comprising:

fastening the fitting ring to the post using a screw.

15. The method of claim 13, further comprising:

connecting the fitting ring to the post without welding.

* * * * *